US009799342B2

(12) United States Patent
Ishikawa et al.

(10) Patent No.: US 9,799,342 B2
(45) **Date of Patent: *Oct. 24, 2017**

(54) BANDWIDTH EXTENSION METHOD, BANDWIDTH EXTENSION APPARATUS, PROGRAM, INTEGRATED CIRCUIT, AND AUDIO DECODING APPARATUS

(71) Applicant: Panasonic Intellectual Property Corporation of America, Torrance, CA (US)

(72) Inventors: Tomokazu Ishikawa, Osaka (JP); Takeshi Norimatsu, Hyogo (JP); Huan Zhou, Singapore (SG); Kok Seng Chong, Singapore (SG); Haishan Zhong, Singapore (SG)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 49 days.

This patent is subject to a terminal disclaimer.

(21) Appl. No.: 14/698,933

(22) Filed: Apr. 29, 2015

(65) Prior Publication Data

US 2015/0248894 A1 Sep. 3, 2015

Related U.S. Application Data

(63) Continuation of application No. 13/389,276, filed as application No. PCT/JP2011/003168 on Jun. 6, 2011, now Pat. No. 9,093,080.

(30) Foreign Application Priority Data

Jun. 9, 2010 (JP) ..... 2010-132205

(51) Int. Cl.
*G10L 19/02* (2013.01)
*G10L 21/038* (2013.01)
*G10L 21/04* (2013.01)

(52) U.S. Cl.
CPC ..... *G10L 19/02* (2013.01); *G10L 21/038* (2013.01); *G10L 21/04* (2013.01)

(58) Field of Classification Search
CPC ..... G10L 21/038; G10L 19/008; G10L 19/24; G10L 19/0208; G10L 19/02; G10L 19/12
See application file for complete search history.

(56) References Cited

U.S. PATENT DOCUMENTS 5,073,938 A 12/1991 Galand
6,680,972 B1 1/2004 Liljeryd et al.
(Continued)

FOREIGN PATENT DOCUMENTS

CN 101361116 2/2009
JP 63-273898 11/1988
(Continued)

OTHER PUBLICATIONS

International Search Report issued Jun. 28, 2011 in International (PCT) Application No. PCT/JP2011/003168.
(Continued)

*Primary Examiner* — Douglas Godbold
*Assistant Examiner* — Mark Villena
(74) *Attorney, Agent, or Firm* — Wenderoth, Lind & Ponack, L.L.P.

(57) ABSTRACT

To provide a bandwidth extension method which allows reduction of computation amount in bandwidth extension and suppression of deterioration of quality in the bandwidth to be extended. In the bandwidth extension method: a low frequency bandwidth signal is transformed into a QMF domain to generate a first low frequency QMF spectrum;
(Continued)

pitch-shifted signals are generated by applying different shifting factors on the low frequency bandwidth signal; a high frequency QMF spectrum is generated by time-stretching the pitch-shifted signals in the QMF domain; the high frequency QMF spectrum is modified; and the modified high frequency QMF spectrum is combined with the first low frequency QMF spectrum.

5 Claims, 17 Drawing Sheets

(56) References Cited

U.S. PATENT DOCUMENTS

| | | | | |
|---|---|---|---|---|
| 7,386,306 | B2 | 6/2008 | Laroia et al. | |
| 7,693,183 | B2 | 4/2010 | Oh et al. | |
| 7,693,706 | B2 | 4/2010 | Oh et al. | |
| 7,702,407 | B2 | 4/2010 | Oh et al. | |
| 7,706,905 | B2 | 4/2010 | Oh et al. | |
| 7,761,177 | B2 | 7/2010 | Oh et al. | |
| 7,797,163 | B2 | 9/2010 | Pang et al. | |
| 7,805,293 | B2 * | 9/2010 | Takada | G10L 21/0364 330/278 |
| 8,068,841 | B2 | 11/2011 | Laroia et al. | |
| 8,090,586 | B2 | 1/2012 | Oh et al. | |
| 8,126,709 | B2 * | 2/2012 | Truman | G10L 21/038 704/200 |
| 8,150,701 | B2 | 4/2012 | Oh et al. | |
| 8,170,883 | B2 | 5/2012 | Oh et al. | |
| 8,208,641 | B2 | 6/2012 | Oh et al. | |
| 8,214,220 | B2 | 7/2012 | Oh et al. | |
| 8,239,209 | B2 | 8/2012 | Oh et al. | |
| 8,296,155 | B2 | 10/2012 | Pang et al. | |
| 8,351,611 | B2 | 1/2013 | Oh et al. | |
| 8,386,268 | B2 | 2/2013 | Nagel et al. | |
| 8,411,869 | B2 | 4/2013 | Oh et al. | |
| 8,488,819 | B2 | 7/2013 | Pang et al. | |
| 8,521,313 | B2 | 8/2013 | Oh et al. | |
| 8,543,386 | B2 | 9/2013 | Oh et al. | |
| 8,577,686 | B2 | 11/2013 | Oh et al. | |
| 8,606,586 | B2 | 12/2013 | Nagel et al. | |
| 8,626,515 | B2 | 1/2014 | Oh et al. | |
| 8,688,441 | B2 | 4/2014 | Ramabadran et al. | |
| 2004/0028244 | A1 | 2/2004 | Tsushima et al. | |
| 2004/0078194 | A1 | 4/2004 | Liljeryd et al. | |
| 2004/0078205 | A1 | 4/2004 | Liljeryd et al. | |
| 2004/0125878 | A1 | 7/2004 | Liljeryd et al. | |
| 2005/0171785 | A1 * | 8/2005 | Nomura | G10L 21/038 704/500 |
| 2005/0233752 | A1 | 10/2005 | Laroia et al. | |
| 2005/0250502 | A1 | 11/2005 | Laroia et al. | |
| 2007/0067162 | A1 | 3/2007 | Villemoes et al. | |
| 2008/0126081 | A1 * | 5/2008 | Geiser | G10L 21/038 704/201 |
| 2008/0219475 | A1 | 9/2008 | Oh et al. | |
| 2008/0221907 | A1 | 9/2008 | Pang et al. | |
| 2008/0228475 | A1 | 9/2008 | Oh et al. | |
| 2008/0228499 | A1 | 9/2008 | Oh et al. | |
| 2008/0228501 | A1 | 9/2008 | Pang et al. | |
| 2008/0235006 | A1 | 9/2008 | Pang et al. | |
| 2008/0255857 | A1 | 10/2008 | Pang et al. | |
| 2008/0275711 | A1 | 11/2008 | Oh et al. | |
| 2008/0279388 | A1 | 11/2008 | Oh et al. | |
| 2008/0294444 | A1 | 11/2008 | Oh et al. | |
| 2008/0304513 | A1 | 12/2008 | Oh et al. | |
| 2008/0310640 | A1 | 12/2008 | Oh et al. | |
| 2008/0312914 | A1 | 12/2008 | Rajendran et al. | |
| 2008/0319765 | A1 | 12/2008 | Oh et al. | |
| 2009/0003611 | A1 | 1/2009 | Oh et al. | |
| 2009/0003635 | A1 | 1/2009 | Pang et al. | |
| 2009/0006105 | A1 | 1/2009 | Oh et al. | |
| 2009/0006106 | A1 | 1/2009 | Pang et al. | |
| 2009/0028344 | A1 | 1/2009 | Pang et al. | |
| 2009/0055196 | A1 | 2/2009 | Oh et al. | |
| 2009/0063140 | A1 * | 3/2009 | Villemoes | G10L 19/0204 704/211 |
| 2009/0119110 | A1 | 5/2009 | Oh et al. | |
| 2009/0144062 | A1 | 6/2009 | Ramabadran et al. | |
| 2009/0164227 | A1 | 6/2009 | Oh et al. | |
| 2009/0216541 | A1 | 8/2009 | Oh et al. | |
| 2009/0216544 | A1 | 8/2009 | Villemoes et al. | |
| 2009/0225991 | A1 | 9/2009 | Oh et al. | |
| 2009/0234656 | A1 | 9/2009 | Oh et al. | |
| 2009/0271204 | A1 | 10/2009 | Tammi | |
| 2009/0274308 | A1 | 11/2009 | Oh et al. | |
| 2009/0287494 | A1 | 11/2009 | Pang et al. | |
| 2010/0063802 | A1 * | 3/2010 | Gao | G10L 21/038 704/201 |
| 2011/0054885 | A1 | 3/2011 | Nagel et al. | |
| 2011/0178808 | A1 | 7/2011 | Pang et al. | |
| 2011/0178810 | A1 | 7/2011 | Villemoes et al. | |
| 2011/0182431 | A1 | 7/2011 | Pang et al. | |
| 2011/0196687 | A1 | 8/2011 | Pang et al. | |
| 2011/0246208 | A1 | 10/2011 | Pang et al. | |
| 2011/0282675 | A1 | 11/2011 | Nagel et al. | |
| 2012/0010880 | A1 | 1/2012 | Nagel et al. | |
| 2012/0065983 | A1 | 3/2012 | Ekstrand et al. | |
| 2012/0158409 | A1 | 6/2012 | Nagel et al. | |
| 2013/0090933 | A1 | 4/2013 | Villemoes et al. | |

FOREIGN PATENT DOCUMENTS

| | | |
|---|---|---|
| JP | 2001-521648 | 11/2001 |
| JP | 2007-272059 | 10/2007 |
| JP | 2008-519290 | 6/2008 |
| JP | 2009-163257 | 7/2009 |
| RU | 2 372 748 | 11/2009 |
| WO | 98/57436 | 12/1998 |
| WO | 2005/043511 | 5/2005 |
| WO | 2005/109916 | 11/2005 |
| WO | 2006/048814 | 5/2006 |
| WO | 2008/157296 | 12/2008 |
| WO | 2009/070387 | 6/2009 |
| WO | 2009/095169 | 8/2009 |
| WO | 2009/115211 | 9/2009 |
| WO | 2010/086461 | 8/2010 |
| WO | 2010/112587 | 10/2010 |
| WO | 2010/136459 | 12/2010 |
| WO | 2011/000780 | 1/2011 |

OTHER PUBLICATIONS

Max Neuendorf et al., "A Novel Scheme for Low Bitrate Unified Speech and Audio Coding—MPEG RM0", the 126$^{th}$ Audio Engineering Society Convention Paper 7713, Munich, Germany, May 2009, pp. 1-13, (3.3 SBR Enhancement).

Frederik Nagel and S. Disch, "A Harmonic Bandwidth Extension Method for Audio Codecs", IEEE International Conference on Acoustics, Speech and Signal Processing, Apr. 2009, entire text, all drawings.

Martin Wolters et al., "A Closer Look Into MPEG-4 High Efficiency AAC", the 115$^{th}$ Audio Engineering Society, Convention Paper, Oct. 2003, New York, NY, USA, entire text, all drawings.

Erik Larsen et al., "Efficient High-Frequency Bandwidth Extension of Music and Speech", the 112$^{th}$ Audio Engineering Society Convention Paper 5627, Munich, Germany, May 2002, entire text, all drawings.

Office Action and Search Report issued Feb. 7, 2014 in corresponding Chinese Application No. 201180003213.4, with partial English translation.

Extended European Search Report issued Oct. 6, 2014 in European Application No. 11792129.6.

Zhou Huan et al., "Core Experiment on the eSBR module of USAC", International Organisation for Standardisation, ISO/IEC JTC1/SC29/WG11, MPEG2009/M16933, Xi'an, China, Oct. 2009.

Bernd Elder et al., "A Time-Warped MDCT Approach to Speech Transform Coding", Audio Engineering Society, Convention Paper 7710, Presented at the 126$^{th}$ Convention, May 7-10, 2009, pp. 588-595.

(56) References Cited

OTHER PUBLICATIONS

Decision of Grant issued Feb. 1, 2016 in Russian Application No. 2012104234, with English translation.
Max Neuendorf et al., "A Novel Scheme for Low Bitrate Unified Speech and Audio Coding—MPEG RM0", the 126$^{th}$ Audio Engineering Society Convention Paper 7713, Munich, Germany, May 2009, pp. 5 to 6, (3.3 SBR Enhancement).
Laroche and Dolson, "New Phase-Vocoder Techniques for Pitch-shifting, Harmonizing and Other Exotic Effects", Proc. 1999 IEEE Workshop on Applications of Signal Processing to Audio and Acoustics, New Paliz, New York, Oct. 17-20, 1999, pp. 91-94.
Office Action issued Jan. 23, 2017 in Canadian Patent Application No. 2,770,287.

* cited by examiner

BANDWIDTH EXTENSION METHOD, BANDWIDTH EXTENSION APPARATUS, PROGRAM, INTEGRATED CIRCUIT, AND AUDIO DECODING APPARATUS

TECHNICAL FIELD

The present invention relates to a bandwidth extension method for extending a frequency bandwidth of an audio signal.

BACKGROUND ART

Audio bandwidth extension (BWE) technology is typically used in modern audio codecs to efficiently code wide-band audio signal at low bit rate. Its principle is to use a parametric representation of the original high frequency (HF) content to synthesize an approximation of the HF from the lower frequency (LF) data.

FIG. 1 is a diagram showing such a BWE technology-based audio codec. In its encoder, a wide-band audio signal is firstly separated (101 & 103) into LF and HF part; its LF part is coded (104) in a waveform preserving way; meanwhile, the relationship between its LF part and HF part is analyzed (102) (typically, in frequency domain) and described by a set of HF parameters. Due to the parameter description of the HF part, the multiplexed (105) waveform data and HF parameters can be transmitted to decoder at a low bit rate.

In the decoder, the LF part is firstly decoded (107). To approximate original HF part, the decoded LF part is transformed (108) to frequency domain, the resulting LF spectrum is modified (109) to generate a HF spectrum, under the guide of some decoded HF parameters. The HF spectrum is further refined (110) by post-processing, also under the guide of some decoded HF parameters. The refined HF spectrum is converted (111) to time domain and combined with the delayed (112) LF part. As a result, the final reconstructed wide-band audio signal is outputted.

Note that in the BWE technology, one important step is to generate a HF spectrum from the LF spectrum (109). There are a few ways to realize it, such as copying the LF portion to the HF location, non-linear processing or upsampling.

A most well known audio codec that uses such a BWE technology is MPEG-4 HE-AAC, where the BWE technology is specified as SBR (spectral band replication) or SBR technology, where the HF part is generated by simply copying the LF portion within QMF representation to the HF spectral location.

Such a spectral copying operation, also called as patching, is simple and proved to be efficient for most cases. However, at very low bitrates (e.g. <20 kbits/s mono), where only small LF part bandwidths are feasible, such SBR technology can lead to undesired auditory artifact sensations such as roughness and unpleasant timbre (for example, see Non-Patent Literature (NPL) 1).

Therefore, to avoid such artifacts resulting from mirroring or copying operation presented in low bitrate coding scenario, the standard SBR technology is enhanced and extended with the following main changes (for example, see NPL 2):

(1) to modify the patching algorithm from copying pattern to a phase vocoder driven patching pattern (2) to increase adaptive time resolution for post-processing parameters.

As a result of the first modification (aforementioned (1)), by spreading the LF spectrum with multiple integer factors, the harmonic continuity in the HF is ensured intrinsically. In particular, no unwanted roughness sensation due to beating effects can emerge at the border between low frequency and high frequency and between different high frequency parts (for example, see NPL 1).

And the second modification (aforementioned (2)) facilitates the refined HF spectrum to be more adaptive to the signal fluctuations in the replicated frequency bands.

As the new patching preserves harmonic relation, it is named as harmonic bandwidth extension (HBE). The advantages of the prior-art HBE over standard SBR have also been experimentally confirmed for low bit rate audio coding (for example, see NPL 1).

Note that the above two modifications only affect the HF spectrum generator (109), the remaining processes in HBE are identical to those in SBR.

FIG. 2 is a diagram showing the HF spectrum generator in the prior art HBE. It should be noted that the HF spectrum generator includes a T-F transform 108 and a HF reconstruction 109. Given a LF part of a signal, suppose its HF spectrum composes of (T−1) HF harmonic patches (each patching process produces one HF patch), from $2^{nd}$ order (the HF patch with the lowest frequency) to T-th order (the HF patch with the highest frequency). In prior art HBE, all these HF patches are generated independently in parallel derived from phase vocoders.

As shown in FIG. 2, (T−1) phase vocoders (201~203) with different stretching factors, (from 2 to k) are employed to stretch the input LF part. The stretched outputs, with different lengths, are bandpass filtered (204~206) and resampled (207~209) to generate HF patches by converting time dilatation into frequency extension. By setting stretching factor as two times of resampling factor, the HF patches maintain the harmonic structure of the signal and have the double length of the LF part. Then all HF patches are delay aligned (210~212) to compensate the potential different delay contributions from the resampling operation. In the last step, all delay-aligned HF patches are summed up and transformed (213) into QMF domain to produce the HF spectrum.

Observing the above HF spectrum generator, it has a high computation amount. The computation amount mainly comes from time stretching operation, realized by a series of Short Time Fourier Transform (STFT) and Inverse Short Time Fourier Transform (ISTFT) transforms adopted in phase vocoders, and the succeeding QMF operation, applied on time stretched HF part.

A general introduction on phase vocoder and QMF transform is described as below.

A phase vocoder is a well-known technique that uses frequency-domain transformations to implement time-stretching effect. That is, to modify a signal's temporal evolution while its local spectral characteristics are kept unchanged. Its basic principle is described below.

FIG. 3A and FIG. 3B are diagrams showing the basic principle of time stretching performed by the phase vocoder.

Divide audio into overlap blocks and respace these blocks where the hop size (the time-interval between successive blocks) is not the same at the input and at the output, as illustrated in FIG. 3A. Therein, the input hop size $R_a$ is smaller than the output hop size $R_s$, as a result, the original signal is stretched with a rate r shown in (Equation 1) below.

[Math 1]

$$r = \frac{R_a}{R_s} \quad \text{(Equation 1)}$$

As shown in FIG. 3B, the respaced blocks are overlapped in a coherent pattern, which requires frequency domain transformation. Typically, input blocks are transformed into frequency, after a proper modification of phases, the new blocks are transformed back to output blocks.

Following the above principle, most classic phase vocoders adopt short time Fourier transform (STFT) as the frequency domain transform, and involve an explicit sequence of analysis, modification and resynthesis for time stretching.

The QMF banks transform time domain representations to joint time-frequency domain representations (and vice versa), which is typically used in parametric-based coding schemes, like the spectral band replication (SBR), parametric stereo coding (PS) and spatial audio coding (SAC), etc. A characteristic of these filter banks is that the complex-valued frequency (subband) domain signals are effectively oversampled by a factor of two. This enables post-processing operations of the subband domain signals without introducing aliasing distortion.

In more detail, given a real valued discrete time signal x(n), with the analysis QMF bank, the complex-valued subband domain signals $s_k(n)$ are obtained through (Equation 2) below.

[Math 2]

$$s_k(n) = \sum_{l=0}^{L-1} x(M \cdot n - l)p(l)e^{j\frac{\pi}{M}(k+0.5)(l+\alpha)} \quad \text{(Equation 2)}$$

In (Equation 2), p(n) represents a low-pass prototype filter impulse response of order L−1, α represents a phase parameter, M represents the number of bands and k the subband index with k=0, 1, . . . , M−1).

Note that like STFT, QMF transform is also a joint time-frequency transform. That means, it provides both frequency content of a signal and the change in frequency content over time, where the frequency content is represented by frequency subband and timeline is represented by time slot, respectively.

FIG. 4 is a diagram showing QMF analysis and synthesis scheme.

In detail, as illustrated in FIG. 4, a given real audio input is divided into successive overlapping blocks with length of L and hopsize of M (FIG. 4 (*a*)), the QMF analysis process transforms each block into one time slot, composed of M complex subband signals. By this way, the L time domain input samples are transformed into L complex QMF coefficients, composed of L/M time slots and M subbands (FIG. 4 (*b*)). Each time slot, combined with the previous (L/M−1) time slots, is synthesized by the QMF synthesis process to reconstruct M real time domain samples (FIG. 4 (*c*)) with near perfect reconstruction.

CITATION LIST

Non Patent Literature

[NPL 1] Frederik Nagel and Sascha Disch, 'A harmonic bandwidth extension method for audio codecs', IEEE Int. Conf. on Acoustics, Speech and Signal Proc., 2009

[NPL 2] Max Neuendorf, et al, 'A novel scheme for low bitrate unified speech and audio coding—MPEG RM0', in 126$^{th}$ AES Convention, Munich, Germany, May 2009.

SUMMARY OF INVENTION

Technical Problem

A problem associated with the prior-art HBE technology is the high computation amount. The traditional phase vocoder that is adopted by HBE for stretching the signal has a higher computation amount because of applying successive FFTs and IFFTs, that is, successive FFTs (fast Fourier transforms) and IFFTs (inverse fast Fourier transforms); and the succeeding QMF transform increases the computation amount by being applied on the time stretched signal. Furthermore, in general, attempting to reduce the computation amount leads to the potential problem of quality degradation.

Thus, the present invention was conceived in view of the aforementioned problem and has as an object to provide a bandwidth extension method capable of reducing the computation amount in bandwidth extension as well as suppressing quality deterioration in the extended bandwidth.

Solution to Problem

In order to achieve the aforementioned object, the bandwidth extension method according to an aspect of the present invention is a bandwidth extension method for producing a full bandwidth signal from a low frequency bandwidth signal, the method including: transforming the low frequency bandwidth signal into a quadrature mirror filter bank (QMF) domain to generate a first low frequency QMF spectrum; generating pitch-shifted signals by applying different shifting factors on the low frequency bandwidth signal; generating a high frequency QMF spectrum by time-stretching the pitch-shifted signals in a QMF domain; modifying the high frequency QMF spectrum to satisfy high frequency energy and tonality conditions; and generating the full bandwidth signal by combining the modified high frequency QMF spectrum with the first low frequency QMF spectrum.

Accordingly, the high frequency QMF spectrum is generated by time-stretching the pitch-shifted signals in the QMF domain. Therefore, it is possible to avoid the conventional complex processing (successively repeated FFTs and IFFTs, and subsequent QMF transform), for generating the high frequency QMF spectrum, and thus the computation amount can be reduced. Note that like STFT, the QMF transform itself provides joint time-frequency resolution, thus, QMF transform replaces the series of STFT and ISTFT. In addition, in the bandwidth extension method according to an aspect of the present invention, the pitch-shifted signals are generated by applying mutually different shift coefficients instead of only one shift coefficient, and time stretching is performed on these signals, it is possible to suppress deterioration of quality of the high frequency QMF spectrum.

Furthermore, the generating of a high frequency QMF spectrum includes: transforming the pitch shifted signals into a QMF domain to generate QMF spectra; stretching the QMF spectra along a temporal dimension with different stretching factors to generate harmonic patches; time-aligning the harmonic patches; and summing up the time-aligned harmonic patches.

Furthermore, the stretching includes: calculating the amplitude and phase of a QMF spectrum among the QMF spectra; manipulating the phase to produce a new phase; and combining the amplitude with the new phase to generate a new set of QMF coefficients.

Furthermore, in the manipulating, the new phase is produced on the basis of an original phase of a whole set of QMF coefficients.

Furthermore, in the manipulating, manipulation is performed repeatedly for sets of QMF coefficients, and in the combining, new sets of QMF coefficients are generated.

Furthermore, in the manipulating, a different manipulation is performed depending on a QMF subband index.

Furthermore, in the combining, the new sets of QMF coefficients are overlap-added to generate the QMF coefficients corresponding to a temporally-extended audio signal.

Specifically, the time stretching in the bandwidth extension method according to an aspect of the present invention imitates the STFT-based stretching method by modifying phases of input QMF blocks and overlap-adding the modified QMF blocks with different hop size. From the point of view of computation amount, comparing to the successive FFTs and IFFTs in STFT-based method, such time stretching has a lower computation amount by involving only one QMF analysis transform only. Therefore, it is possible to further reduce the computation amount in bandwidth extension.

Furthermore, in order to achieve the aforementioned object, the bandwidth extension method in another aspect of the present invention is a bandwidth extension method for producing a full bandwidth signal from a low frequency bandwidth signal, the method including: transforming the low frequency bandwidth signal into a quadrature mirror filter bank (QMF) domain to generate a first low frequency QMF spectrum; generating a low order harmonic patch by time-stretching the low frequency bandwidth signal in a QMF domain; generating signals that are pitch shifted, by applying different shift coefficients to the low order harmonic patch, and generating a high frequency QMF spectrum from the signals; modifying the high frequency QMF spectrum to satisfy high frequency energy and tonality conditions; and generating the full bandwidth signal by combining the modified high frequency QMF spectrum with the first low frequency QMF spectrum.

Accordingly, the high frequency QMF spectrum is generated by time-stretching and pitch-shifting the low frequency bandwidth signal in the QMF domain. Therefore, it is possible to avoid the conventional complex processing (successively repeated FFTs and IFFTs, and subsequent QMF transform), for generating the high frequency QMF spectrum, and thus the computation amount can be reduced. In addition, since the pitch-shifted signals are generated by applying mutually different shift coefficients instead of only one shift coefficient, and the high frequency QMF spectrum is generated from these signals, it is possible to suppress deterioration of quality of the high frequency QMF spectrum. Furthermore, since the high frequency QMF spectrum is generated from the low order harmonic patch, it is possible to further suppress deterioration of quality of the high frequency QMF spectrum.

It should be noted that, in the bandwidth extension method according to another aspect of the present invention, the pitch shifting also operates in QMF domain. This is in order to decompose the LF QMF subband on the low order patch into multiple sub-subbands for higher frequency resolution, then mapping those sub-subbands into high QMF subband to generate high order patch spectrum.

Furthermore, the generating of a low order harmonic patch includes: transforming the low frequency bandwidth signal into a second low frequency QMF spectrum; bandpassing the second low frequency QMF spectrum; and stretching the bandpassed second low frequency QMF spectrum along a temporal dimension.

Furthermore, the second low frequency QMF spectrum has finer frequency resolution than the first low frequency QMF spectrum.

Furthermore, the generating of signals includes: bandpassing the low order harmonic patch to generate bandpassed patches; mapping each of the bandpassed patches into high frequency to generate high order harmonic patches; and summing up the high order harmonic patches with the low order harmonic patch.

Furthermore, the bandpassing of the low order harmonic patch includes: splitting each QMF subband in each of the bandpassed patches into multiple sub-subbands; mapping the sub-subbands to high frequency QMF subbands; and combining results of the sub-subband mapping.

Furthermore, the mapping of the sub-subbands to high frequency subbands includes: dividing the sub-subbands of each of the QMF subbands into a stop band part and a pass band part; computing transposed center frequencies of the sub-subbands on the pass band part with patch order dependent factor; mapping the sub-subbands on the pass band part into high frequency QMF subbands according to the center frequencies; and mapping the sub-subbands on the stop band part into high frequency QMF subbands according to the sub-subbands of the pass band part.

It should be noted that, in the bandwidth extension method according to the present invention, the process operations (steps) described above may be combined in any manner.

Such a bandwidth extension method as that according to the present invention is a low computation amount HBE technology which uses a computation amount-reduced HF spectrum generator, which contributes the highest computation amount to HBE. To reduce the computation amount, in the bandwidth extension method according to an aspect of the present invention, a new QMF-based phase vocoder that performs time stretching in QMF domain with a low computation amount is used. Furthermore, in the bandwidth extension method according to another aspect of the present invention, to avoid the possible quality problems associated with the solution, a new pitch shifting algorithm is used that generates high order harmonic patches from low order patch in QMF domain.

It is the object of this invention to design a QMF-based patch where time-stretching, or both time-stretching and frequency-extending can be performed in QMF domain, to make it further, to develop a low computation amount HBE technology driven by a QMF-based phase vocoder.

It should be noted that the present invention can be realized, not only as such a bandwidth extension method, but also as a bandwidth extension apparatus and an integrated circuit that extend the frequency bandwidth of an audio signal using the bandwidth extension method, as a program for causing a computer to extend a frequency bandwidth using the bandwidth extension method, and as a recording medium on which the program is recorded.

Advantageous Effects of Invention

The bandwidth extension method in the present invention designs a new harmonic bandwidth extension (HBE) technology. The core of the technology is to do time stretching or both time stretching and pitch shifting in QMF domain, rather than in traditional FFT domain and time domain, respectively. Comparing to the prior-art HBE technology, the bandwidth extension method in the present invention can provide good sound quality and significantly reduce the computation amount.

DESCRIPTION OF EMBODIMENTS

The following embodiments are merely illustrative for the principles of various inventive steps. It is understood that variations of the details described herein will be apparent to others skilled in the art.

(First Embodiment)

Hereinafter, a HBE scheme (harmonic bandwidth extension method) and a decoder (audio decoder or audio decoding apparatus) using the same, in the present invention, shall be described.

Figure 5:
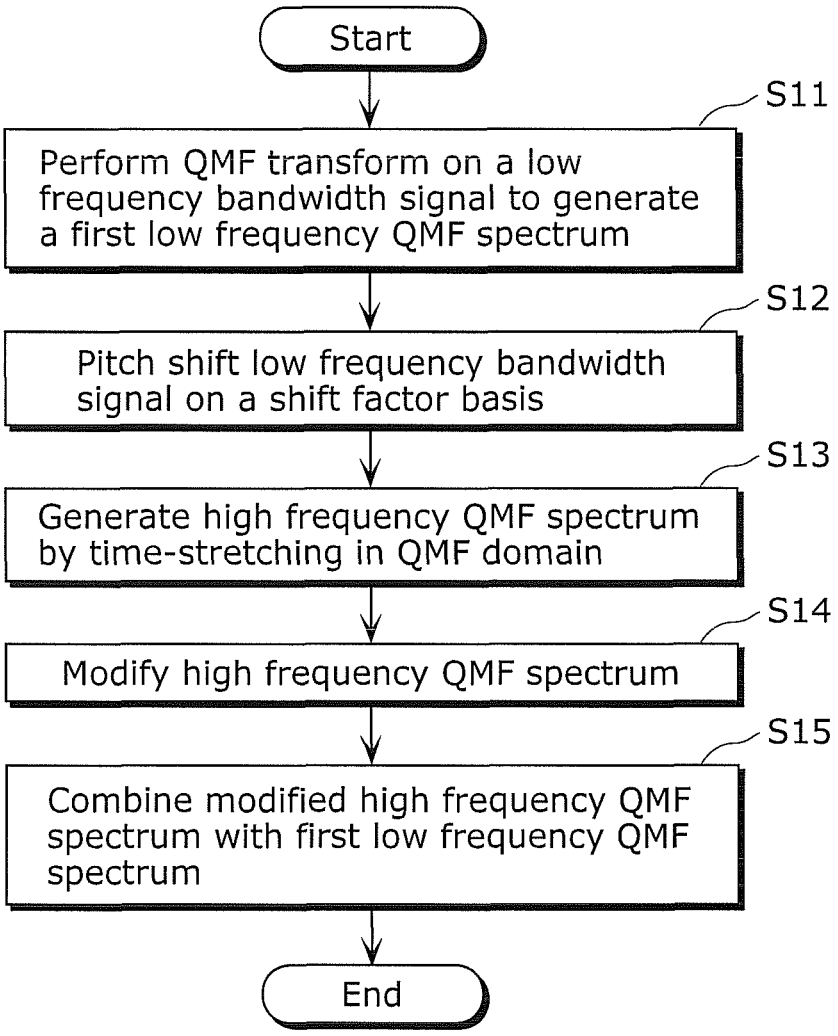
FIG. 5 is a flowchart showing a bandwidth extension method in a first embodiment of the present invention.

FIG. 5 is a flowchart showing the bandwidth extension method in the present embodiment.

This bandwidth extension method is a bandwidth extension method for producing a full bandwidth signal from a low frequency bandwidth signal, the method including: transforming the low frequency bandwidth signal into a quadrature mirror filter bank (QMF) domain to generate a first low frequency QMF spectrum (hereafter referred to as the first transform step); generating pitch-shifted signals by applying different shifting factors on the low frequency bandwidth signal (hereafter referred to as the pitch shift step); generating a high frequency QMF spectrum by time-stretching the pitch-shifted signals in a QMF domain (hereafter referred to as the high frequency generation step); modifying the high frequency QMF spectrum to satisfy high frequency energy and tonality conditions (hereafter referred to as the spectrum modification step); and generating the full bandwidth signal by combining the modified high frequency QMF spectrum with the first low frequency QMF spectrum (hereafter referred to as the full bandwidth generation step).

It should be noted that the first transform step (S11) is performed by a T-F transform unit 1406 to be described later, the pitch shift step (S12) is performed by sampling units 504 to 506 and a time resampling unit 1403 to be described later. In addition, the high frequency generation step (S13) is performed by QMF transform units 507 to 509, phase vocoders 510 to 512, a QMF transform unit 404, and a time-stretching unit 1405 to be described later. Furthermore, the full bandwidth generation step (S15) is performed by an addition unit 1410 to be described later.

Furthermore, the high frequency generation step includes: transforming the pitch shifted signals into a QMF domain to generate QMF spectra (hereafter referred to as the second transform step); stretching the QMF spectra along a temporal dimension with different stretching factors to generate harmonic patches (hereafter referred to as the harmonic patch generation step); time-aligning the harmonic patches (hereafter referred to as the alignment step); and summing up the time-aligned harmonic patches (hereafter referred to as the sum-up step).

It should be noted that the second transform step is performed by the QMF transform units 507 to 509 and the QMF transform unit 1404, and the harmonic patch generation step is performed by the phase vocoders 510 to 512 and the time-stretching unit 1405. Furthermore, the alignment step is performed by delay alignment units 513 to 515 to be described, and the sum-up step is performed by an addition unit 516 to be described later.

In a HBE scheme in the present embodiment, a HF spectrum generator in HBE technology is designed with the pitch shifting processes in time domain, succeeded by the vocoder driven time stretching processes in QMF domain.

Figure 6:
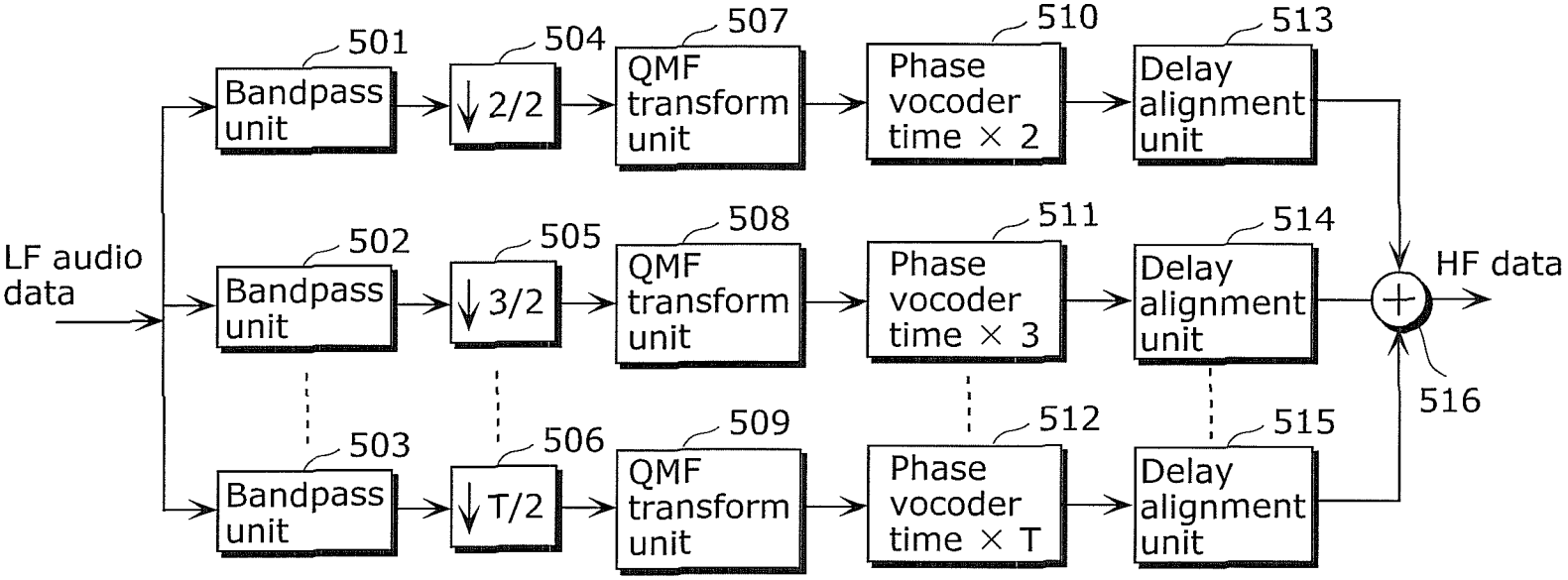
FIG. 6 is a diagram showing a HF spectrum generator in the first embodiment of the present invention.

FIG. 6 is a diagram showing the HF spectrum generator used in the HBE scheme in the present embodiment. The HF spectrum generator includes: bandpass units 501, 502, . . . , and 503; the sampling units 504, 505, . . . , and 506; the QMF transform units 507, 508, . . . , and 509; the phase vocoders 510, 511, . . . , and 512; the delay alignment units 513, 514, . . . , and 515; and the addition unit 516.

A given LF bandwidth input is firstly bandpassed (501~503) and resampled (504~506) to generate its HF bandwidth portions. Those HF bandwidth portions are transformed (507~509) into QMF domain, the resulting QMF outputs are time stretched (510~512) with stretching factors as two times of the according resampling factors. The stretched HF spectrums are delay aligned (513~515) to compensate the potential different delay contributions from resampling process and summed up (516) to generate the final HF spectrum. It should be noted that each of the numerals 501 to 516 in parentheses above denote a constituent element of the HF spectrum generator.

Figure 2:
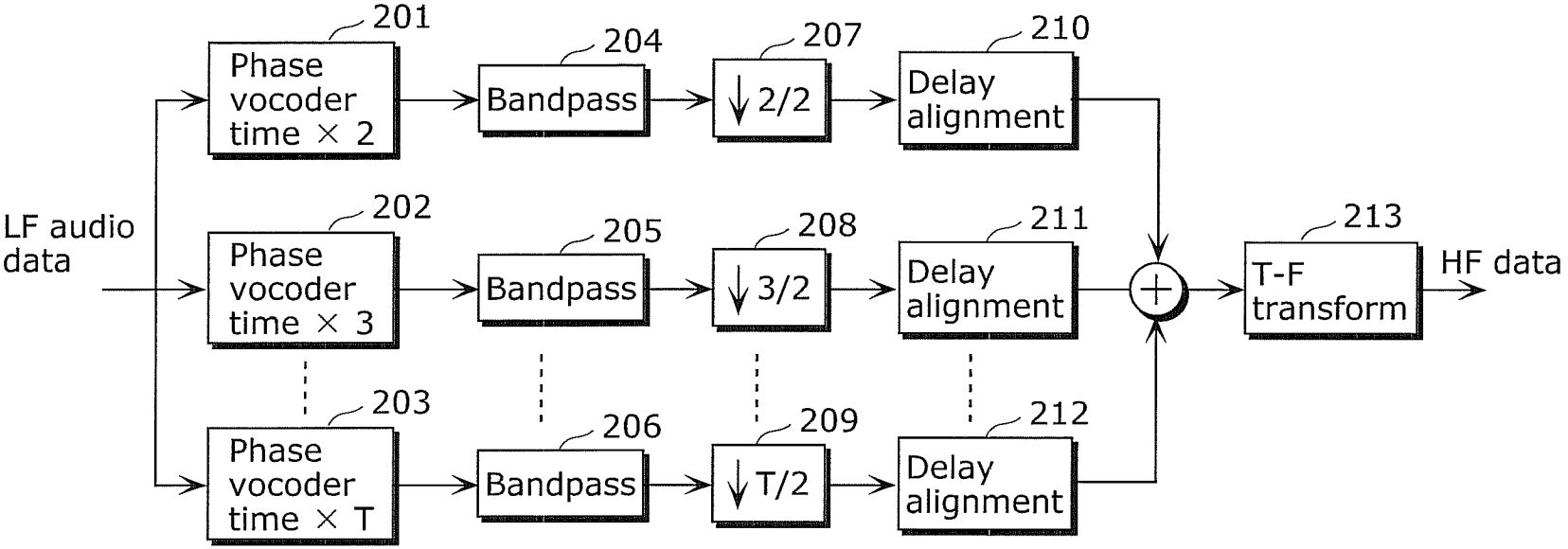
FIG. 2 is a diagram showing a harmonic structure preserved HF spectrum generator.
Figure 3A:
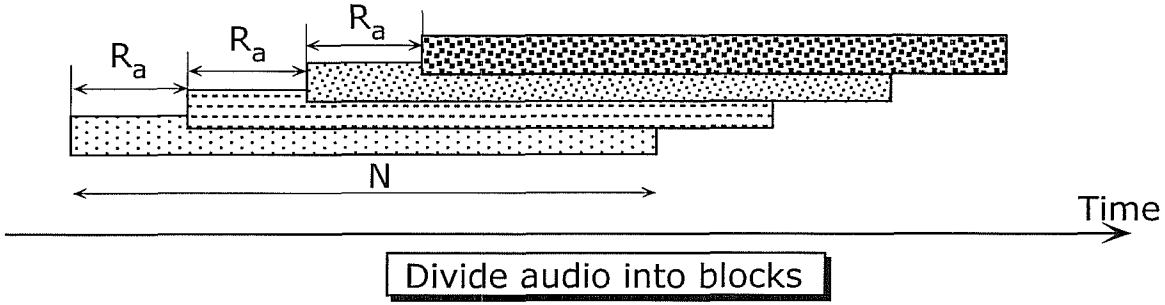
FIG. 3A is a diagram showing the principle of time stretching by respacing audio blocks.
Figure 3B:
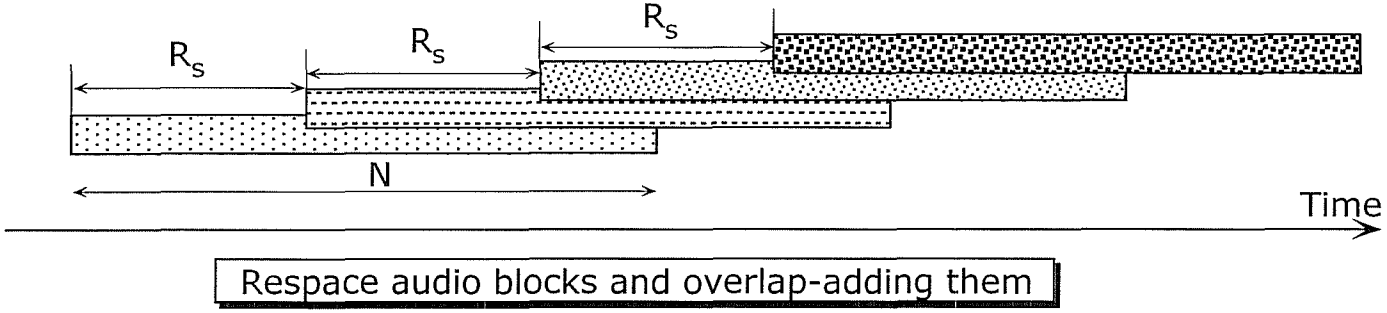
FIG. 3B is a diagram showing the principle of time stretching by respacing audio blocks.
Figure 4:
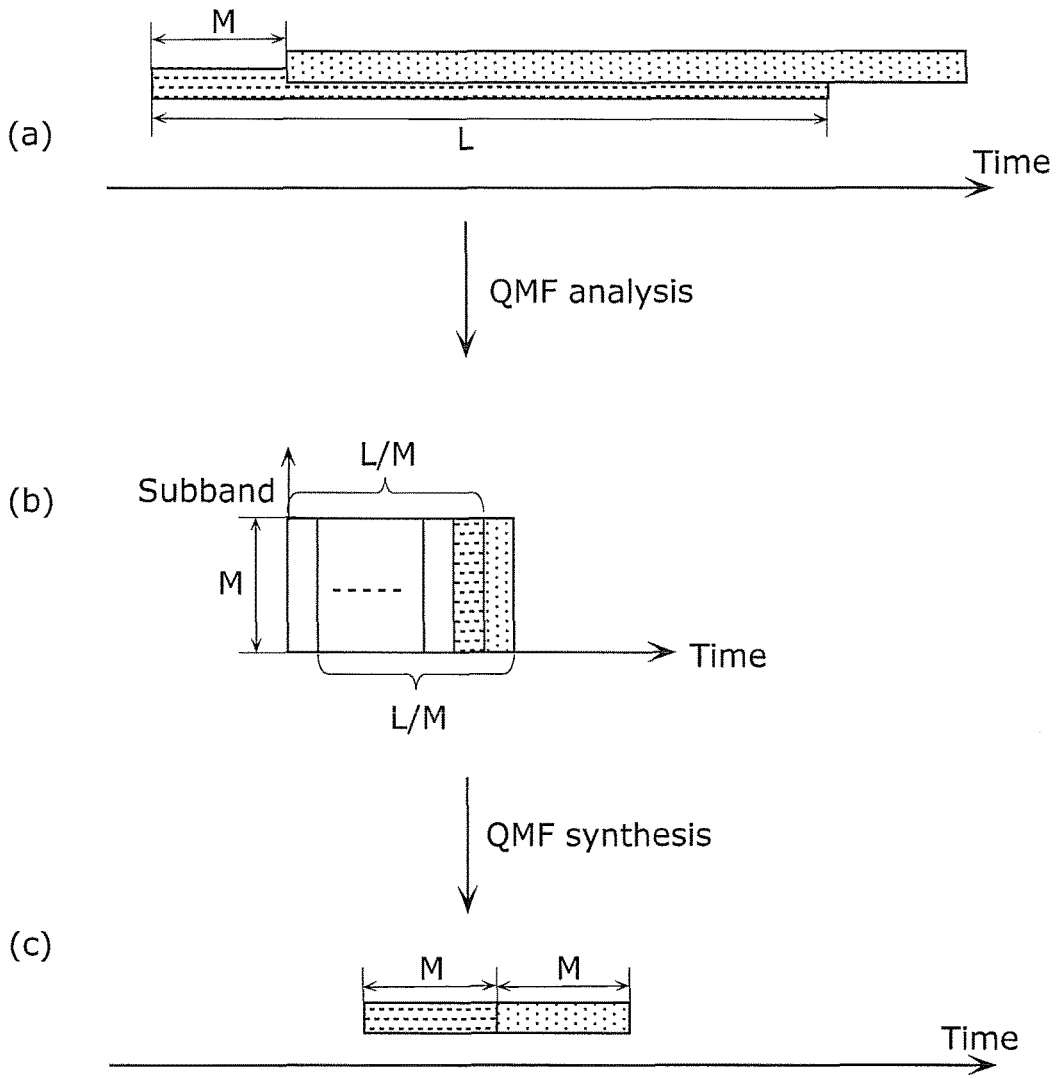
FIG. 4 is a diagram showing QMF analysis and synthesis scheme.

Comparing the scheme in the present embodiment with the prior-art scheme (FIG. 2), it can be see the main differences are 1) more QMF transforms are applied; and 2) time stretching operation is performed in QMF domain, not in FFT domain. The detailed time stretching operation in QMF domain will be described later with more details.

Figure 7:
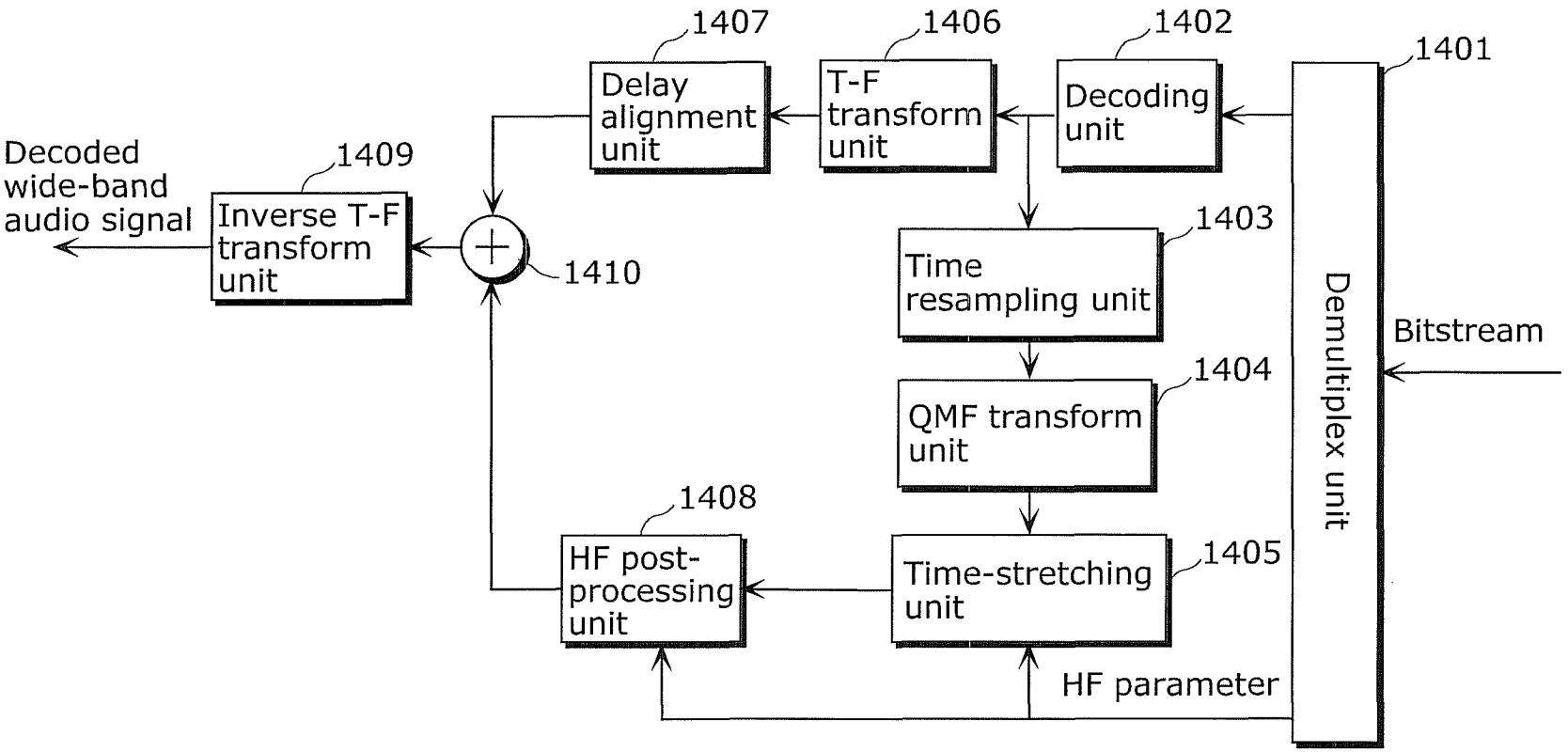
FIG. 7 is a diagram showing an audio decoder in the first embodiment of the present invention.

FIG. 7 is a diagram showing a decoder adopting the HF spectrum generator in the present embodiment. The decoder (audio decoding apparatus) includes a demultiplex unit 1401, a decoding unit 1402, the time resampling unit 1403, the QMF transform unit 1404, and the time-stretching unit 1405, It should be noted that, in the present embodiment, the demultiplex unit 1401 corresponds to the separation unit which separates a coded low frequency bandwidth signal from coded information (bitstream). Furthermore, the inverse T-F transform unit 1409 corresponds to the inverse transform unit which transforms a full bandwidth signal, from a quadrature mirror filter bank (QMF) domain signal to a time domain signal.

With the decoder, the bitstream is demultiplexed (1401) first, the signal LF part is then decoded (1402). To approximate original HF part, the decoded LF part (low frequency bandwidth signal) is resampled (1403) in time domain to generate HF part, the resulting HF part is transformed (1404) into QMF domain, the resulting HF QMF spectrum is stretched (1405) along the temporal direction, the stretched HF spectrum is further refined (1408) by post-processing, under the guide of some decoded HF parameters. Meanwhile, the decoded LF part is also transformed (1406) into QMF domain. In the end, the refined HF spectrum combined (1410) with delayed (1407) LF spectrum to produce full bandwidth QMF spectrum. The resulting full bandwidth QMF spectrum is converted (1409) back to time domain to output the decoded wideband audio signal. It should be noted that each of the numerals 1401 to 1410 in parentheses above denotes a constituent element of the decoder.

The Time Stretching Method

The time stretching process of the HBE scheme in the present embodiment is, for an audio signal, its time stretched signal can be generated by QMF transform, phase manipulations and inverse QMF transform. Specifically, the harmonic patch generation step includes: calculating the amplitude and phase of a QMF spectrum among the QMF spectra (hereafter referred to as the calculation step); manipulating the phase to produce a new phase (hereafter referred to as the phase manipulation step); and combining the amplitude with the new phase to generate a new set of QMF coefficients (hereafter referred to as the QMF coefficient generation step). It should be noted that each of the calculating step, the phase manipulation step, and the QMF coefficient generation step is performed by a module 702 to be described later.

Figure 8:
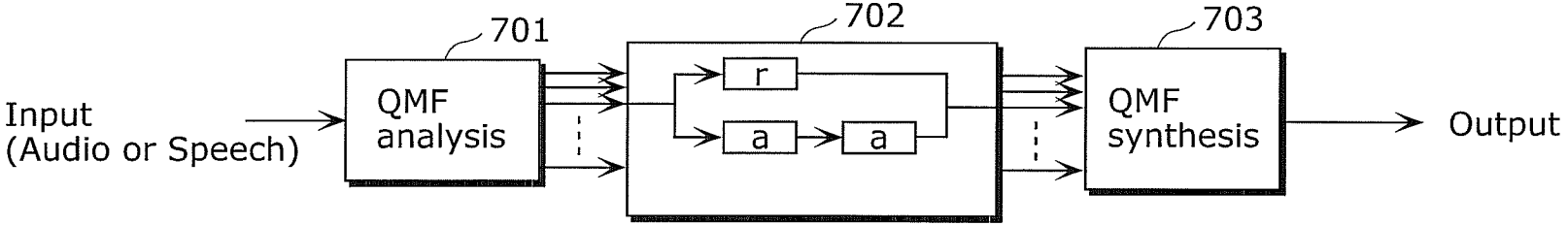
FIG. 8 is a diagram showing a scheme of change time scale of a signal based on QMF transform in the first embodiment of the present invention.

FIG. 8 is a diagram showing a QMF-based time stretching process performed by the QMF transform unit 1404 and the time stretching unit 1405. Firstly, an audio signal is transformed into a set of QMF coefficients, say, X(m,n), by QMF analysis transform (701). These QMF coefficients are modified in module 702. Wherein, for each QMF coefficients, its amplitude r and phase a are calculated, say, X(m,n)=r(m,n)·exp(j·a(m,n)). The phases a(m,n) are modified (manipulated) to a˜(m,n). The modified phases a˜ and original amplitudes r construct a new set of QMF coefficients. For example, a new set of QMF coefficients are shown in (Equation 3) below.

[Math 3]

$$\tilde{X}(m,n)=r(m,n)\cdot\exp(j\cdot\tilde{a}(m,n)) \quad \text{(Equation 3)}$$

Finally, the new set of QMF coefficients are transformed (703) into a new audio signal, corresponding to the original audio signal with modified time scale.

The QMF-based time stretching algorithm in the HBE scheme in the present embodiment imitates the STFT-based stretching algorithm: 1) the modification stage uses the instantaneous frequency concept to modify phases; 2) to reduce the computation amount, the overlap-adding is performed in QMF domain using the additivity property of QMF transform.

Below is the detailed description of the time stretching algorithm in the HBE scheme in the present embodiment.

Assuming there are 2L real-valued time domain signal, x(n), to be stretched with a stretch factor s, after QMF analysis stage, there are 2L QMF complex coefficients, composed of 2L/M time slots and M subbands.

Note that like STFT-based stretching method, the transformed QMF coefficients are optionally, subject to analysis windowing before the phase manipulation. In this invention, this can be realized on either time domain or QMF domain.

On time domain, a time domain signal can be naturally windowed as in (Equation 4) below.

[Math 4]

$$x(n)=x(n)\cdot h(\mathrm{mod}(n,L)) \quad \text{(Equation 4)}$$

The mod(.) in (Equation 4) means modulation operation.

On the QMF domain, the equivalent operation can be realized by:

1) Transforming the analysis window h(n) (with length of L) into QMF domain to produce H(v,k) with L/M time slots and M subbands.

2) Simplifying the QMF representation of the window as shown in (Equation 5) below.

[Math 5]

$$H_0(v)=\sum_{k=0}^{M-1} H(v,k) \quad \text{(Equation 5)}$$

Here, v=0, . . . , L/M−1.

3) Perform the analysis windowing in QMF domain by $X(m,k)=X(m,k)\cdot H_0(w)$ where w=mod(m,L/M) (It should be noted that mod(.) means modulation operation).

Furthermore, in the HBE scheme in the present embodiment, in the phase manipulation step, the new phase is produced on the basis of an original phase of a whole set of QMF coefficients. Specifically, in the present embodiment, as a detailed realization of the time stretching, phase manipulation is performed on the basis of QMF block.

Figure 9:
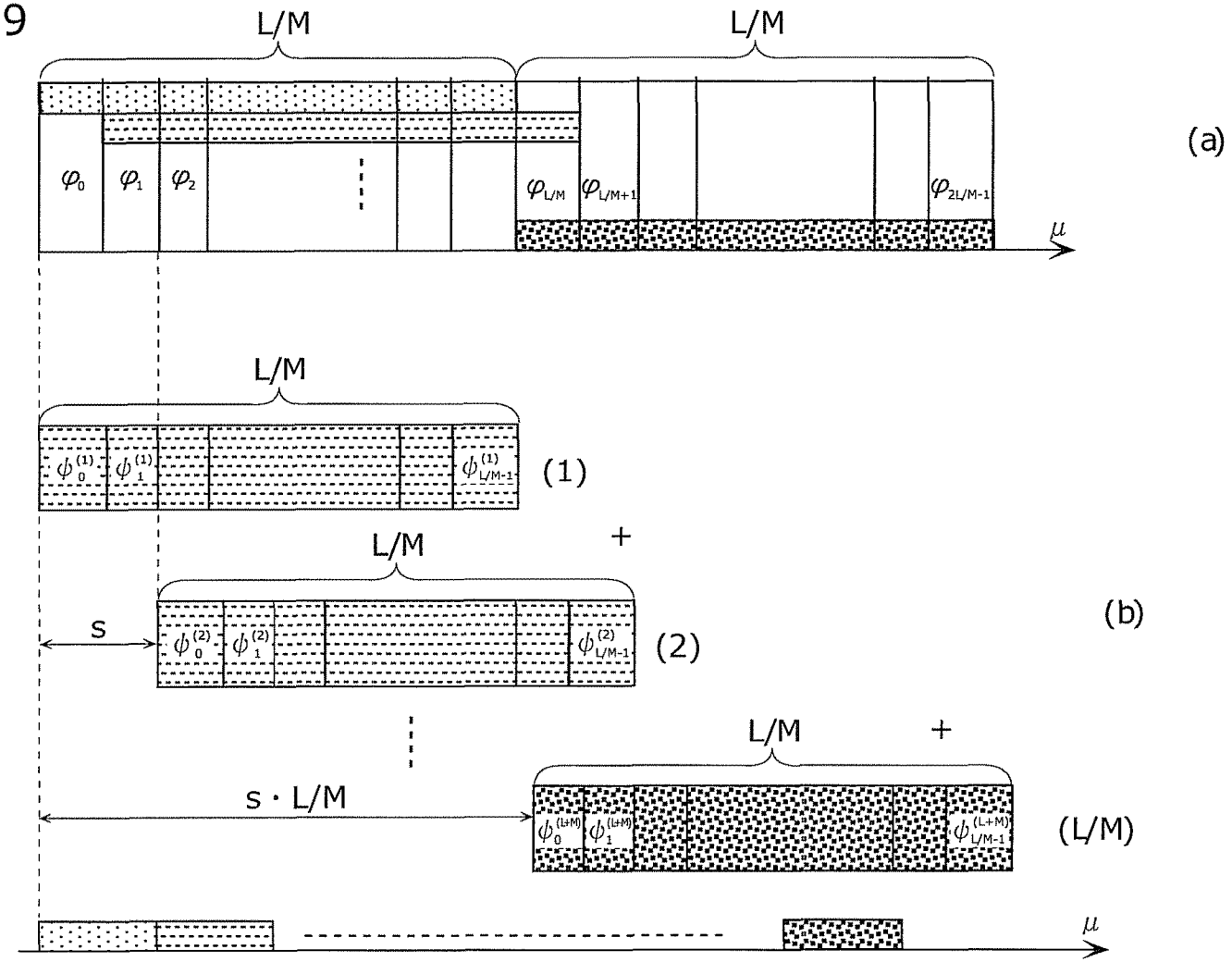
FIG. 9 is a diagram showing a time stretching method in QMF domain in the first embodiment of the present invention.

FIG. 9 is a diagram of a time stretching method in QMF domain.

These original QMF coefficients can be treated as L+1 overlapped QMF blocks with hop size of 1 time slot and block length of L/M time slots, as illustrated in (a) in FIG. 9.

To ensure no phase-jumping effect, each original QMF block is modified to generate a new QMF block with modified phases, and phases of the new QMF blocks should be continuous at the point μ·s for the overlapping (μ)-th and (μ+1)-th new QMF block, which is equivalent to continuous at the joint points μ·M·s (μ∈N) in time domain.

Furthermore, in the HBE scheme in the present embodiment, in the phase manipulation step, manipulation is performed repeatedly for sets of QMF coefficients, and in the QMF coefficient generation step, new sets of QMF coefficients are generated. In this case, the phases are modified on the block basis following the below criteria.

Assuming the original phases are $\phi_u(k)$ for the given QMF coefficients X(u,k), for u=0, . . . , 2L/M−1 and k=0, . . . , M−1. Each original QMF block is sequentially modified to a new QMF block, as illustrated in (b) in FIG. 9, where new QMF blocks are illustrated with different fill patterns.

In the following, $\psi_u^{(n)}(k)$ represents phase information of the n-th new QMF block for n=1, . . . , L/M, u=0, . . . , L/M−1 and k=0, 1, . . . , M−1. These new phases, depending on whether the new block is respaced or not, are designed as follows.

Assuming the 1st new QMF block $X^{(1)}(u,k)$ (u=0, . . . , L/M−1) is not respaced. So the new phase information $\psi_u^{(1)}(k)$ is identical to $\phi_u(k)$. That is, $\psi_u^{(1)}(k)=\phi_u(k)$ for u=0, . . . , L/M−1 and k=0, 1, . . . , M−1.

For the 2nd new QMF block $X^{(2)}(u,k)$ (u=0, . . . , L/M−1), it is respaced with hop size of s time slot (e.g. 2 time slots, as illustrated in FIG. 9). In this case, the instantaneous frequencies at the beginning of the block should be consistent to those at the s-th time slot in the 1st new QMF block $X^{(1)}(u,k)$. Thus, the instantaneous frequencies for the 1st time slot of $X^{(2)}(u,k)$ should be identical to those for the 2nd time slot in the original QMF block. That is, $\psi_0^{(2)}(k)=\psi_0^{(1)}(k)+s\Delta\phi_1(k)$.

Furthermore, since the phases for the ist time slot are changed, the remaining phases are adjusted accordingly to preserve the original instantaneous frequencies. That is, $\psi_u^{(2)}(k)=\psi_{u-1}^{(2)}(k)+\Delta\phi_{u+1}(k)$ for u=1, . . . , L/M−1, where $\Delta\phi_u(k)=\phi_u(k)-\phi_{u-1}(k)$ represents the original instantaneous frequencies for the original QMF block.

For the succeeding synthesis blocks, the same phase modification rules are applied. That is, for the m-th new QMF block (m=3, . . . , L/M), its phases $\psi_u^{(m)}(k)$ are decided as shown below.

$$\psi_0^{(m)}(k)=\psi_0^{(m-1)}(k)+s\Delta\phi_{m-1}(k)$$

$$\psi_u^{(m)}(k)=\psi_{u-1}^{(m)}(k)+\Delta\phi_{m+u-1}(k) \quad \text{for } u=1, \ldots, L/M-1.$$

Incorporating with the original block amplitude information, the above new phases result in new L/M blocks.

Here, in the HBE scheme in the present embodiment, in the phase manipulation step, a different manipulation is performed depending on a QMF subband index. Specifically, the above phase modification method can be designed differently for QMF odd subbands and even subbands, respectively.

It is based on that for a tonal signal, its instantaneous frequency in QMF domain is associated with the phase difference, Δφ(n,k)=φ(n,k)−φ(n−1,k), in different ways.

In more detail, it is found that the instantaneous frequency ω(n,k) can be determined through (Equation 6) below.

[Math. 6]

$$\omega(n,k)=\begin{cases} princ\ \arg(\Delta\varphi(n,k))/\pi+k & k \text{ is even} \\ princ\ \arg(\Delta\varphi(n,k)-\pi)/\pi+k & k \text{ is odd} \end{cases} \quad \text{(Equation 6)}$$

In (Equation 6), the princ arg(α) means the principle angle of α, defined by (Equation 7) below.

[Math 7]

$$\text{princ arg}(\alpha)=\text{mod}(\alpha+\pi,-2\pi)+\pi \quad \text{(Equation 7)}$$

In the equation, mod(a,b) denotes the modulation of a over b.

As a result, for example, in the above phase modification method, the phase difference could be elaborated as in (Equation 8) below.

[Math. 8]

$$\Delta\varphi_u(k)=\begin{cases} princ\ \arg(\varphi_n(k)-\varphi_{u-1}(k)) & k \text{ is even} \\ princ\ \arg(\varphi_n(k)-\varphi_{u-1}(k)-\pi) & k \text{ is odd} \end{cases} \quad \text{(Equation 8)}$$

Furthermore, in the HBE scheme in the present embodiment, in the QMF coefficient generation step, the new sets of QMF coefficients are overlap-added to generate the QMF coefficients corresponding to a temporally-extended audio signal. Specifically, in order to reduce the computation amount, the QMF synthesis operation is not directly applied on each individual new QMF block. Instead, it applied on the overlap-added results of those new QMF blocks.

Note that like STFT-based stretching method, the new QMF coefficients are optionally, subject to synthesis windowing before the overlap-adding. In the present embodiment, like the analysis windowing process, the synthesis windowing can be realized as shown below.

$$X^{(n+1)}(u,k)=X^{(n+1)}(u,k)\cdot H_0(w), \text{ where } w=\text{mod}(u,L/M)$$

Then, because of the additivity of QMF transform, all the new L/M blocks can be overlap-added, with the hop size of s time slots, prior to the QMF synthesis. The overlap-added results Y(u,k) can be obtained through the equation below.

[Math 9]

$$Y(ns+u,k)=Y(ns+u,k)+X^{(n+1)}(u,k) \quad \text{(Equation 9)}$$

Here, n=0, . . . , L/M−1, u=1, . . . , L/M, and k=0, . . . , M−1.

The final audio signal can be generated by applying the QMF synthesis on the Y(u,k), which corresponds to original signal with modified time scale.

Comparing the QMF-based stretching method in the HBE scheme in the present embodiment with the prior-art STFT-based stretching method, it is worth noting that the inherent time resolution of QMF transform helps to significantly reduce the computation amount, which can only be obtained with a series of STFT transforms in prior-art STFT-based stretching method.

The following computation amount analysis shows a rough computation amount comparison result by only considering the computation amount contributed from transforms.

Assuming the computation amount of STFT of size L is $\log_2(L)\cdot L$ and the computation amount of a QMF analysis transform is about twice that of a FFT transform, the transform computation amount involved in the prior-art HF spectrum generator is approximated as shown below.

[Math 10]

$$L/R_a\cdot 2\cdot L\cdot\log_2(L)\cdot(T-1)+(2L)\log_2(2L)\approx 2(L/R_a\cdot(T-1)+1)\cdot L\cdot\log_2(L) \quad \text{(Equation 10)}$$

By comparison, the transform computation amount involved in the HF spectrum generator in the present embodiment is approximated as shown in (Equation 11) below.

[Math 11]

$$2\sum_{t=2}^{T}(2L/t)\cdot\log_2(2L/t)\approx 4\sum_{t=2}^{T}1/t\cdot L\cdot\log_2(L) \quad \text{(Equation 11)}$$

For example, assuming L=1024 and Ra=128, the above computation amount comparison can be concreted in Table 1.

TABLE 1

Computation amount comparison between prior art HBE and the proposed HBE with adoption of QMF-based time stretching in the present embodiment

| Harmonic patch number (T) | Transform computation amount involved in time stretching in present embodiment | Transform computation amount involved in prior-art time stretching | Computation amount ratios |
|---|---|---|---|
| 3 | 33335 | 350208 | 9.52% |
| 4 | 42551 | 514048 | 8.28% |
| 5 | 49660 | 677888 | 7.33% |

(Second Embodiment)

Hereinafter, a second embodiment of the HBE scheme (harmonic bandwidth extension method) and a decoder (audio decoder or audio decoding apparatus) using the same shall be described in detail.

Note that with adopting of the QMF-based time stretching method, the HBE technology used the QMF-based time stretching method has much lower computation amount. However, on the other hand, adopting the QMF-based time stretching method also brings two possible problems which have risks to degrade the sound quality.

Firstly, there is quality degradation problem for high order patch. Assume that a HF spectrum is composed with (T−1) patches with corresponding stretching factors as 2, 3, . . . , T. Because the QMF-based time stretching is block based, the reduced number of overlap-add operation in high order patch causes degradation in stretching effect.

Figure 10:
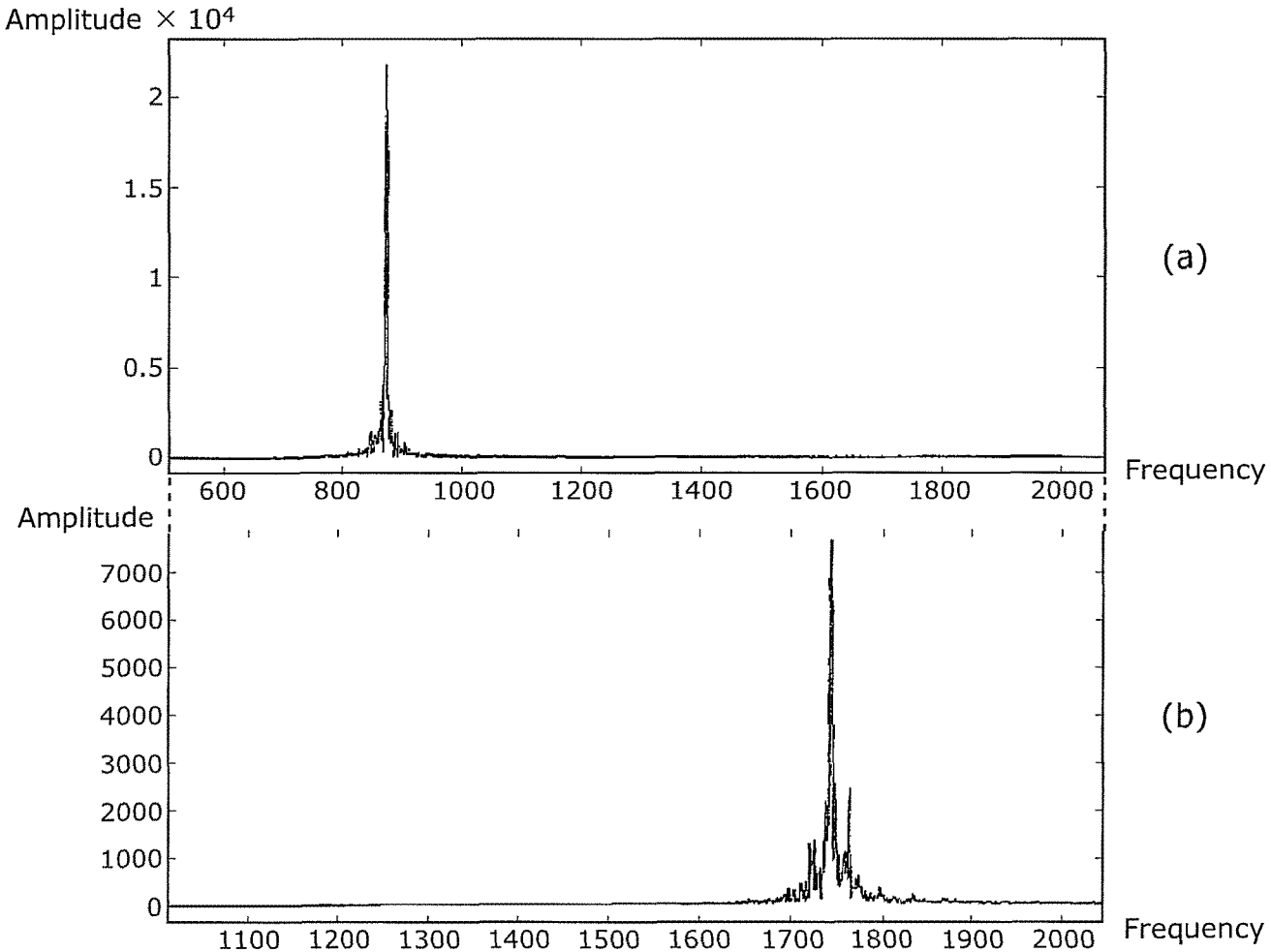
FIG. 10 is a diagram showing comparing stretching effects for a sinusoid tonal signal with different stretching factors.

FIG. 10 is a diagram showing sinusoid tonal signal. The upper panel (a) shows the stretched effect of a $2^{nd}$ order patch for a pure sinusoid tonal signal, the stretched output is basically clean, with only a few other frequency components presented at small amplitudes. While the lower panel (b) shows the stretched effect of a $4^{th}$ order patch for the same sinusoid tonal signal.

Comparing to (a), it can be seen that although the center frequency is correctly shifted in (b), the resulting output also includes some other frequency components with non-ignorable amplitude. This may result in the undesired noises presented in the stretched output.

Secondly, there is possible quality degradation problem for transient signals. Such a quality degradation problem may have 3 potential contribution sources.

The first contribution source is that the transient component may be lost during the resampling. Assuming a transient signal with a Dirac impulse located at an even sample, for a $4^{th}$ order patch with decimation with factor of 2, such a Dirac impulse disappears in the resampled signal. As a result, the resulting HF spectrum has incomplete transient components.

The second contribution source is the misaligned transient components among different patches. Because the patches have different resampling factor, a Dirac impulse located at a specified position may have several components located at the different time slots in the QMF domain.

Figure 11:
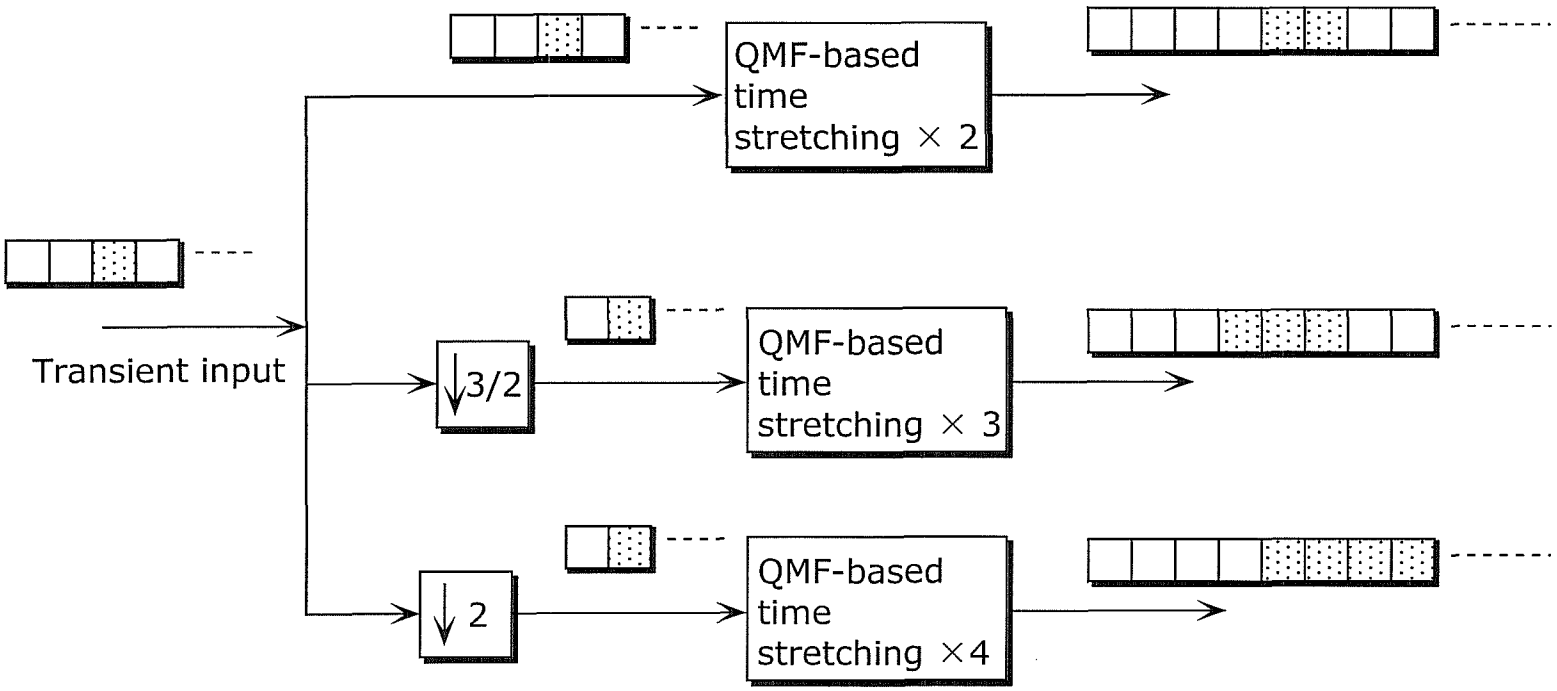
FIG. 11 is a diagram showing misalignment and energy spread effect in HBE scheme.

FIG. 11 is a diagram showing misalignment and energy spread effect. For an input with Dirac impulse (e.g. in FIG. 11, presented as the $3^{rd}$ sample, illustrated in grey), after resampling with different factors, its position is changed to different positions. As a result, the stretched output shows perceptually attenuated transient effect.

The third contribution source is that the energies of transient components are spread unevenly among different patch. As shown in FIG. 11, with the $2^{nd}$ order patch, the associated transient component is spread to the $5^{th}$ and $6^{th}$ samples; with the $3^{rd}$ order patch, to the $4^{th}$~$6^{th}$ samples; and with the $4^{th}$ order patch, to the $5^{th}$~$8^{th}$ samples. As a result, the stretched output has weaker transient effect at higher frequency. For some critical transient signals, the stretched output even shows some annoying pre- and post-echo artefacts.

To overcome the above quality degradation problem, an enhanced HBE technology is desired. However, too complicated solution also increases the computation amount. In the present embodiment, a QMF-based pitch shifting method is used to avoid the possible quality degradation problem and maintain the low computation amount advantage.

As described in detail below, in the HBE scheme (harmonic bandwidth extension method) in the present embodiment, HF spectrum generator in the HBE technology in the present embodiment is designed with both time stretching and pitch shifting process in QMF domain. Furthermore, a decoder (audio decoder or audio decoding apparatus) using the HBE in the present embodiment shall also be described below.

Figure 12:
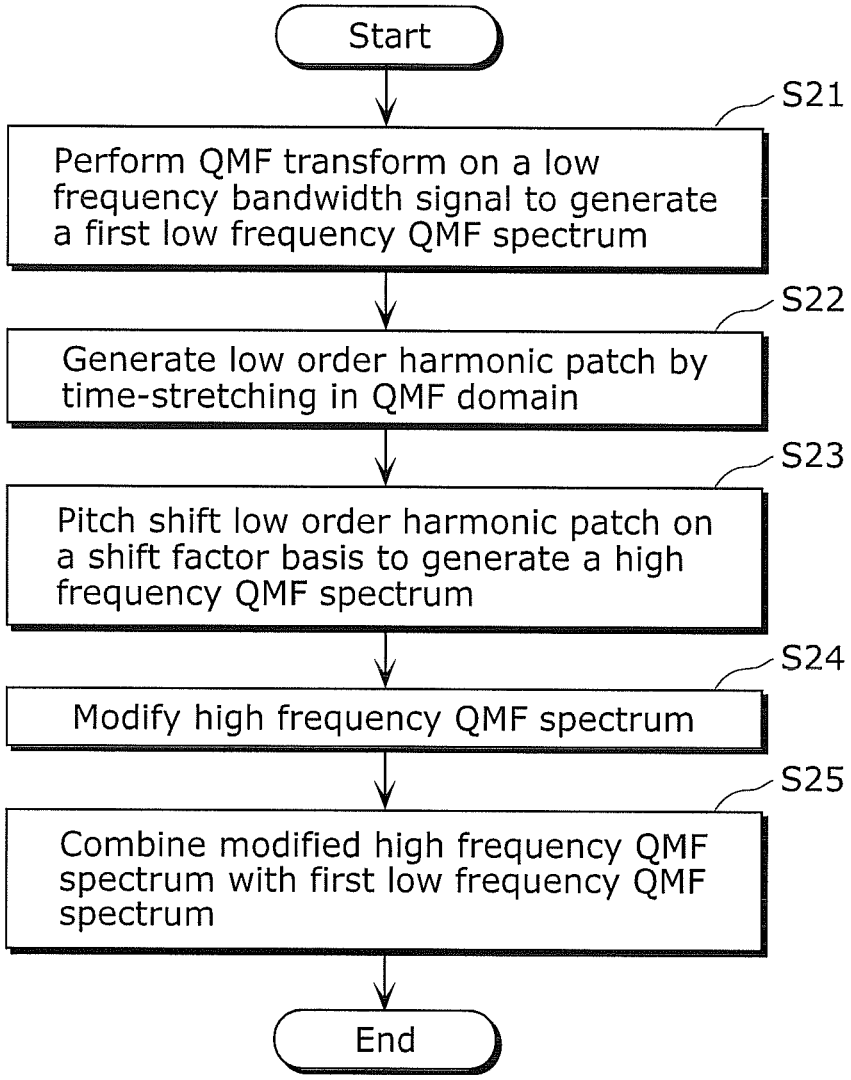
FIG. 12 is a flowchart showing the bandwidth extension method in a second embodiment of the present invention.

FIG. 12 is a flowchart showing the bandwidth extension method in the present embodiment.

This bandwidth extension method is a bandwidth extension method for producing a full bandwidth signal from a low frequency bandwidth signal, the method including: transforming the low frequency bandwidth signal into a quadrature mirror filter bank (QMF) domain to generate a first low frequency QMF spectrum (hereafter referred to as the first transform step); generating a low order harmonic patch by time-stretching the low frequency bandwidth signal in a QMF domain (hereafter referred to as the low order harmonic patch generation step); generating signals that are pitch shifted, by applying different shift coefficients to the low order harmonic patch, and generating a high frequency QMF spectrum from the signals (hereafter referred to as the high frequency generation step); modifying the high frequency QMF spectrum to satisfy high frequency energy and tonality conditions (hereafter referred to as the spectrum modification step); and generating the full bandwidth signal by combining the modified high frequency QMF spectrum with the first low frequency QMF spectrum (hereafter referred to as the full bandwidth generation step).

It should be noted that the first transform step is performed by a T-F transform unit 1508 to be described later, the low order harmonic patch generation step is performed by a QMF transform 1503, a time-stretching unit 1504, a QMF transform unit 601, and a phase vocoder 603 to be described later. In addition, the high frequency generation step is performed by a pitch shifting unit 1506, bandpass units 604 and 605, frequency extension units 606 and 607, and delay alignment units 608 to 610 to be described later. Furthermore, the spectrum modification step is performed by a HF post-processing unit 1507 to be described later, and the full bandwidth generation step is performed by an addition unit 1512.

Furthermore, the low order harmonic patch generation step includes: transforming the low frequency bandwidth signal into a second low frequency QMF spectrum (hereafter referred to as the second transform step); bandpassing the second low frequency QMF spectrum (hereafter referred to as the bandpass step); and stretching the bandpassed second low frequency QMF spectrum along a temporal dimension (hereafter referred to as the stretching step).

It should be noted that the second transform step is performed by the QMF transform unit 601 and the QMF transform unit 1503, the bandpass step is performed by a bandpass unit 602 to be discussed later, and the stretching step is performed by the phase vocoder 603 and the time-stretching unit 1504.

Furthermore, the second low frequency QMF spectrum has finer frequency resolution than the first low frequency QMF spectrum.

Furthermore, the high frequency generation step includes: bandpassing the low order harmonic patch to generate bandpassed patches (hereafter referred to as the patch generation step); mapping each of the bandpassed patches into high frequency to generate high order harmonic patches (hereafter referred to as the high order generation step); and summing up the high order harmonic patches with the low order harmonic patch (hereafter referred to as the sum-up step).

It should be noted that the patch generation step is performed by the bandpass units 604 and 605, the high order generation step is performed by the frequency extension units 606 and 607, and the sum-up step is performed by the an addition unit 611 to be discussed later.

Figure 13:
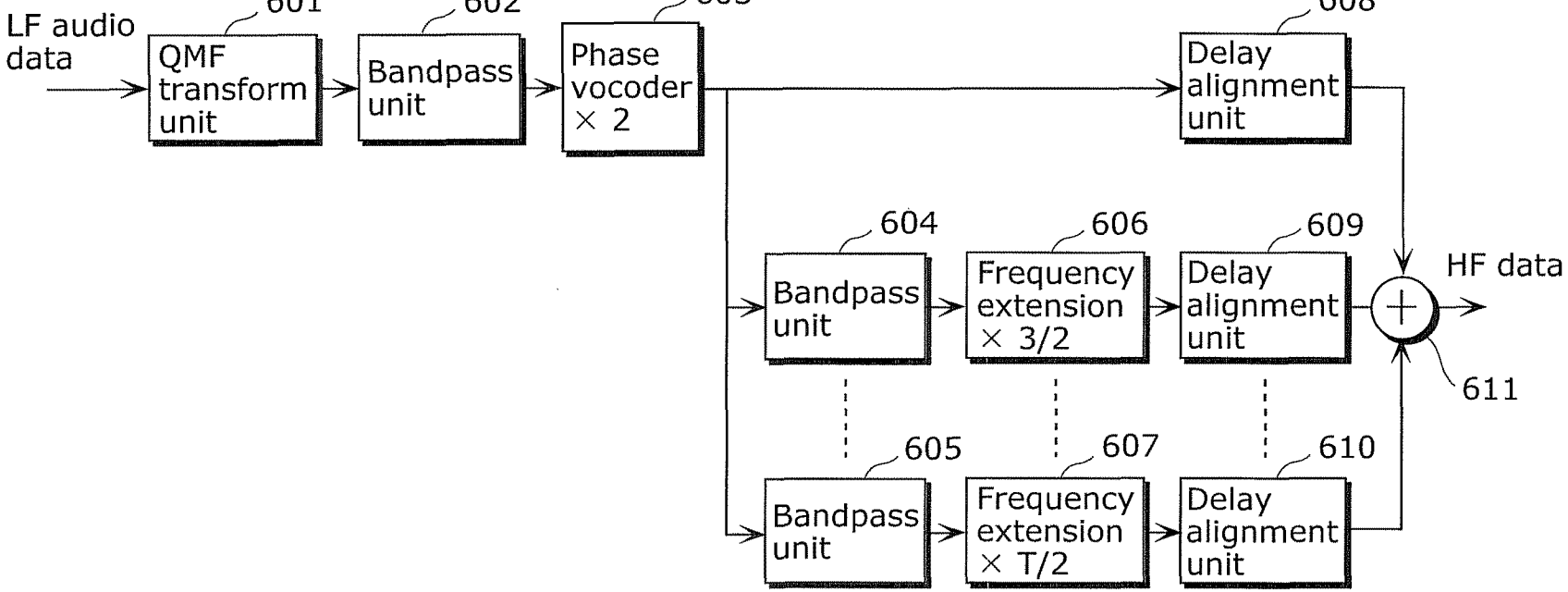
FIG. 13 is a diagram showing an HF spectrum generator in the second embodiment of the present invention.

FIG. 13 is a diagram showing the HF spectrum generator in the HBE scheme in the present embodiment. The HF spectrum generator includes the QMF transform unit 601, the bandpass units 602, 604, . . . , and 605, the phase vocoder 603, the frequency extension unit 606, . . . , and 607, the delay alignment units 608, 609, . . . , and 610, and the addition unit 611.

A given LF bandwidth input is firstly transformed (601) into QMF domain, its bandpassed (602) QMF spectrum is time stretched (603) to double length. The stretched QMF spectrum is bandpassed (604~605) to produce bandlimited (T−2) spectra. The resulting bandlimited spectra are translated (606~607) into higher frequency bandwidth spectra. Those HF spectra are delay aligned (608~610) to compensate the potential different delay contributions from spectrum translation process and summed up (611) to generate the final HF spectrum. It should be noted that each of the numerals 601 to 611 in parentheses above denotes a constituent element of the HF spectrum generator.

Figure 1:
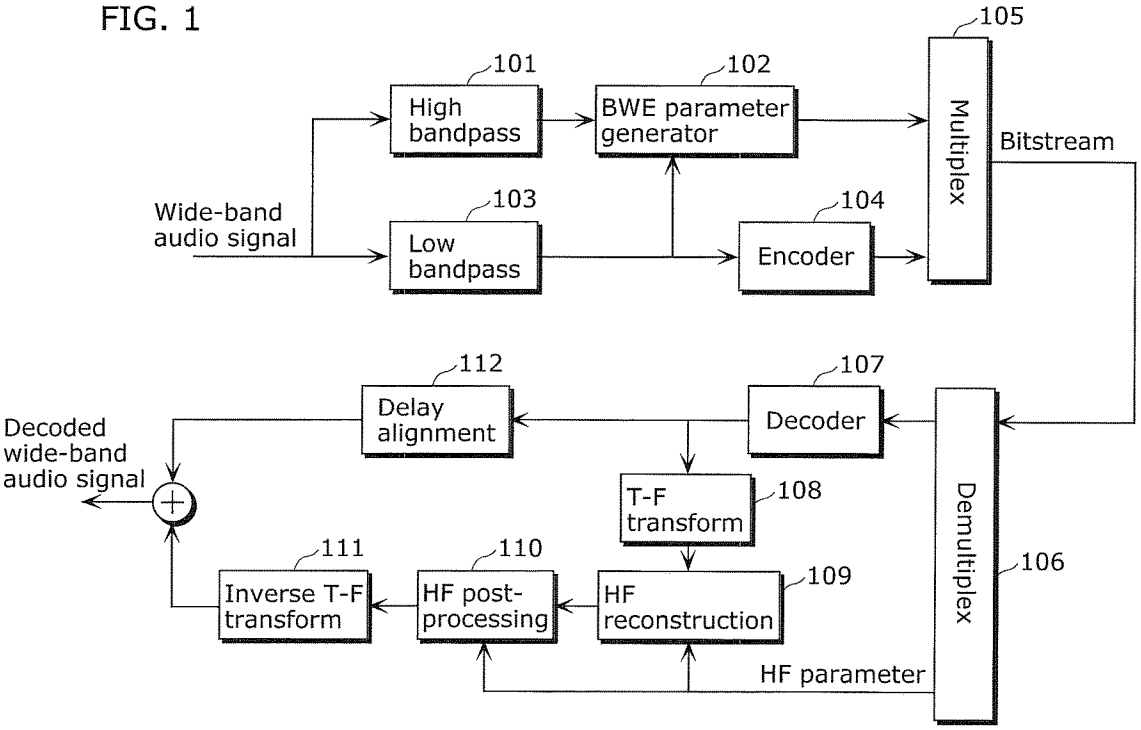
FIG. 1 is a diagram showing an audio codec scheme using normal BWE technology.

Note that comparing to the QMF transform (108 in FIG. 1), the QMF transform in the HBE scheme in the present embodiment (QMF transform unit 601) has finer frequency resolution, the decreasing time resolution will be compensated by the succeeding stretching operation.

Comparing the HBE scheme in the present embodiment with the prior-art scheme (FIG. 2), it can be seen that the main differences are 1) like the first embodiment, the time stretching process is conducted in QMF domain, not in FFT domain; 2) higher order patches are generated based on $2^{nd}$ order patch; 3) the pitch shifting process is also conducted in QMF domain, not in time domain.

Figure 14:
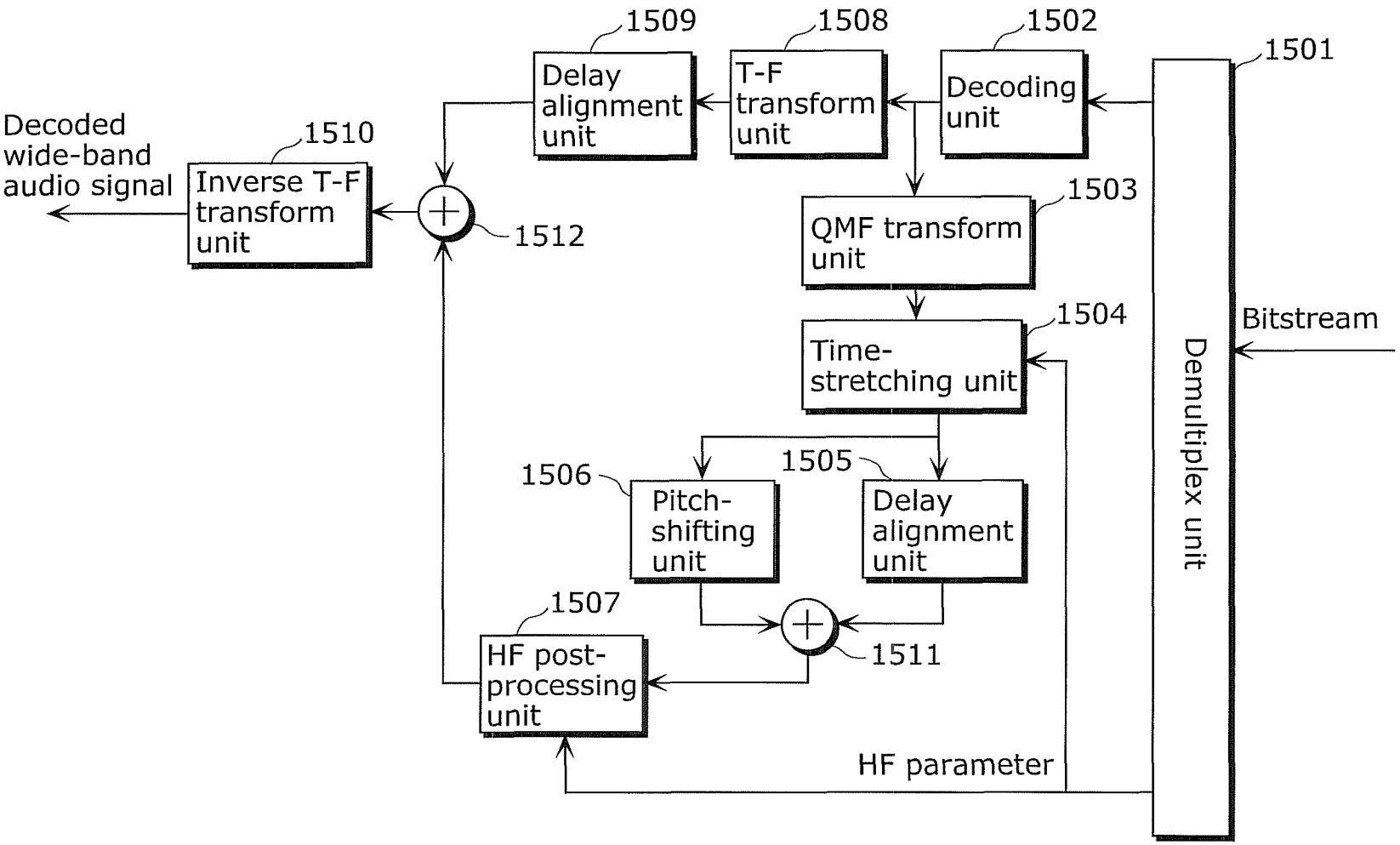
FIG. 14 is a diagram showing an audio decoder in the second embodiment of the present invention.

FIG. 14 is a diagram showing the decoder adopting the HF spectrum generator in the HBE scheme in the present embodiment. The decoder (audio decoding apparatus) includes a demultiplex unit 1501, a decoding unit 1502, the QMF transform unit 1503, the time-stretching unit 1504, a delay alignment unit 1505, the pitch-shifting unit 1506, the HF post-processing unit 1507, the T-F transform unit 1508, a delay alignment unit 1509, an inverse T-F transform unit 1510, and an addition unit 1511. It should be noted that, in the present embodiment, the demultiplex unit 1501 corresponds to the separation unit which separates a coded low frequency bandwidth signal from coded information (bitstream). Furthermore, the inverse T-F transform unit 1510 corresponds to the inverse transform unit which transforms a full bandwidth signal, from a quadrature mirror filter bank (QMF) domain signal to a time domain signal.

With the decoder, the bitstream is demultiplexed (1501) first, the signal LF part is then decoded (1502). To approximate original HF part, the decoded LF part (low frequency bandwidth signal) is transformed (1503) in QMF domain to generate LF QMF spectrum. The resulting LF QMF spectrum is stretched (1504) along the temporal direction to generate a low order HF patch. The low order HF patch is pitch shifted (1506) to generate high order patches. The resulting high order patches are combined with delayed (1505) low order HF patch to generate HF spectrum, the HF spectrum is further refined (1507) by post-processing, under the guide of some decoded HF parameters. Meanwhile, the decoded LF part is also transformed (1508) into QMF domain. In the end, the refined HF spectrum combined with delayed (1509) LF spectrum to produce (1512) full bandwidth QMF spectrum. The resulting full bandwidth QMF spectrum is converted (1510) back to time domain to output the decoded wideband audio signal. It should be noted that each of the numerals 1501 to 1512 denotes a constituent element of the decoder.

The Pitch Shifting Method

A QMF-based pitch shifting algorithm (frequency extending method in QMF domain) for the pitch-shifting unit 1506 in the HBE scheme in the present embodiment is designed by decomposing the LF QMF subbands into plural sub-subbands, transposing those sub-subbands into HF subbands, and combining the resulting HF subbands to generate a HF spectrum. Specifically, the high order generation step includes: splitting each QMF subband in each of the bandpassed patches into multiple sub-subbands (hereafter referred to as the splitting step); mapping the sub-subbands to high frequency QMF subbands (hereafter referred to as the mapping step); and combining results of the sub-subband mapping (hereafter referred to as the combining step).

It should be noted that the splitting step corresponds to step 1 (901~903) to be described later, the mapping step corresponds to steps 2 and 3 (904~909) to be described later, and the combining step corresponds to step 4 (910) to be described later.

Figure 15:
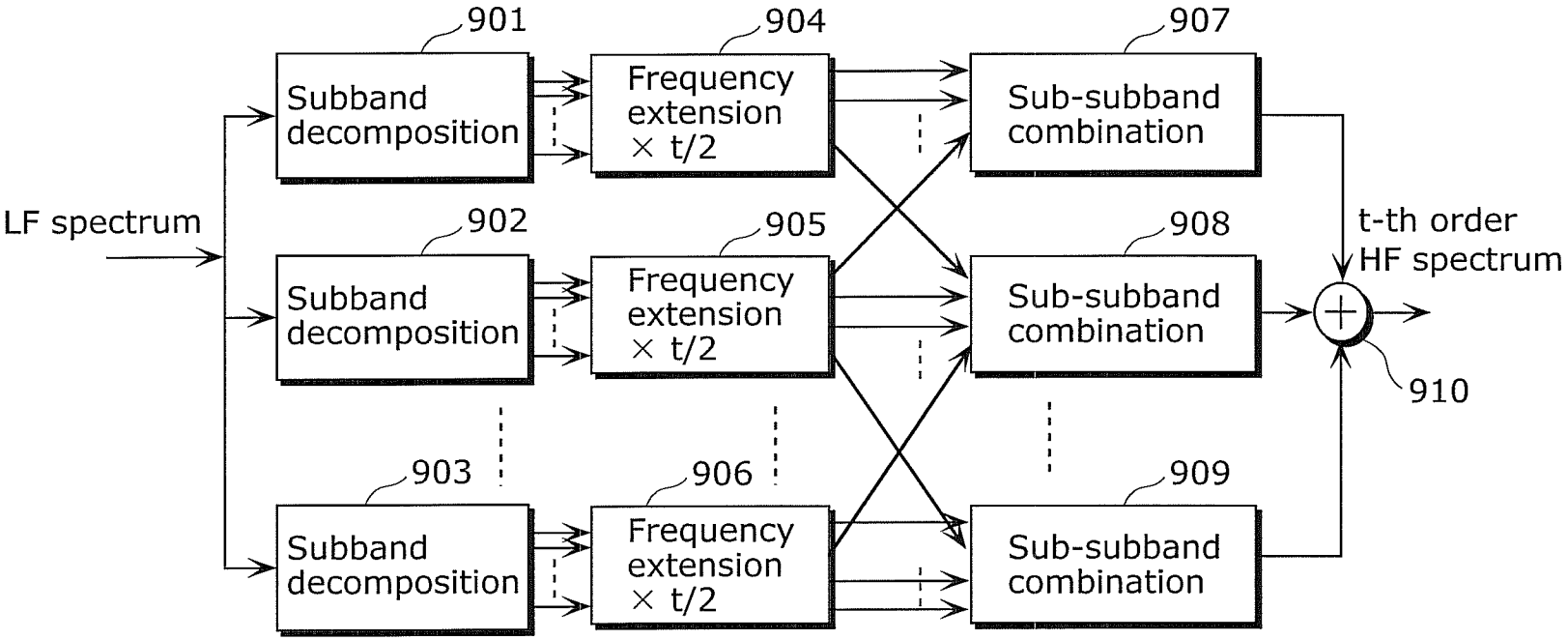
FIG. 15 is a diagram showing a frequency extending method in QMF domain in the second embodiment of the present invention.

FIG. 15 is a diagram showing such a QMF-based pitch shift algorithm. Given a bandpassed spectrum of the $2^{nd}$ order patch, the HF spectrum of a t-th (t>2) order patch can be reconstructed by: 1) decomposing (step 1: 901~903) the given LF spectrum, i.e., each QMF subband inside the LF spectrum is decomposed into multiple QMF sub-subbands; 2) scaling (step 2: 904~906) the center frequencies of those sub-subbands with factor of t/2; 3) mapping (step 3: 907~909) those sub-subbands into HF subbands; 4) summing up all mapped sub-subbands to form HF subbands (step 4: 910).

For step 1, a few methods are available to decompose a QMF subband into multiple sub-subbands in order to obtain better frequency resolution. For example, the so-called Mth band filters that are adopted in MPEG surround codec. In this preferred embodiment of the invention, the subband decomposition is realized by applying an additional set of exponentially modulated filter bank, defined by (Equation 12) below.

[Math 12]

$$g_q(n) = \exp\left\{j\frac{\pi}{Q}\cdot(q+0.5)(n-n_0)\right\} \quad \text{(Equation 12)}$$

Here, q=−Q, −Q+1, . . . , 0, 1, . . . , Q−1 and n=0, 1, . . . , N (where $n_0$ is an integer constant, N is the order of filter bank).

By adopting the above filter bank, a given subband signal, say, the k-th subband signal x(n,k), is decomposed into 2Q sub-subband signals according to (Equation 13) below.

[Math 13]

$$y_q^k(n)=\mathrm{conv}(x(n,k),g_q(n)) \quad \text{(Equation13)}$$

Here, q=−Q, −Q+1, . . . , 0, 1, . . . , Q−1. In the equation, 'conv(.)' denotes the convolution function.

With such an additional complex transform, the frequency spectrum of one subband is further split into 2Q sub-frequency spectrum. From the frequency resolution point of view, if the QMF transform has M-band, its associated subband frequency resolution is HIM and its sub-subband frequency resolution is refined to Π/(2Q·M). In addition, the overall system shown in (Equation 14) is time-invariant, that is, free of aliasing, in spite of the use of downsampling and upsampling.

[Math 14]

$$\sum_{q=-Q}^{Q-1} g_q(p) \quad \text{(Equation 14)}$$

Note that the above additional filter bank is oddly stacked (the factor q+0.5), which means there is no sub-subbands centered around the DC value. Rather, for an even Q number, the center frequencies of the sub-subbands are symmetric around zero.

Figure 16:
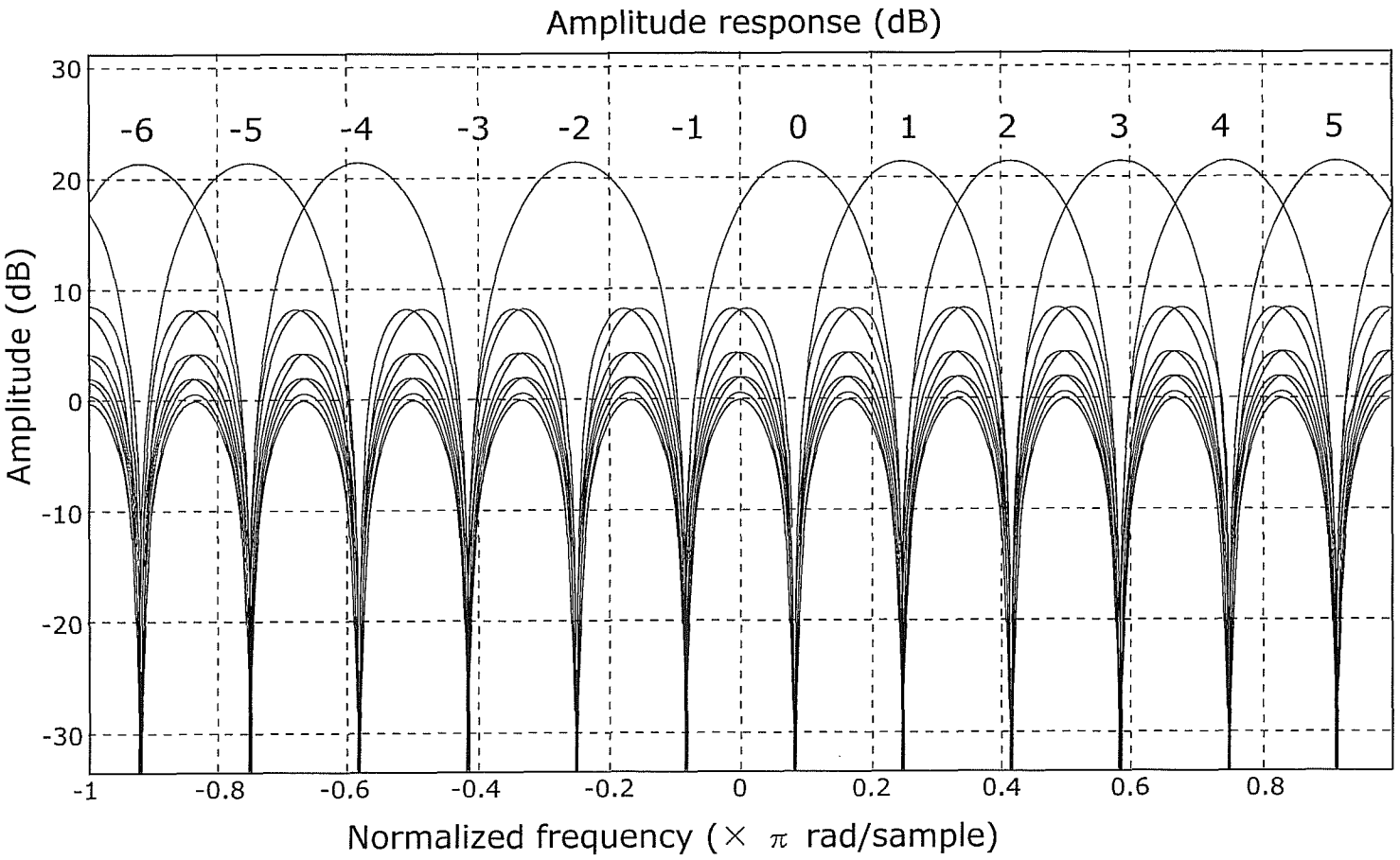
FIG. 16 is a figure showing a sub-subband spectra distribution in the second embodiment of the present invention.

FIG. 16 is a graph showing a sub-subband spectra distribution. Specifically, FIG. 16 shows such a filter bank spectrum distribution for the case of Q=6. The purpose of the oddly stack is to facilitate the later sub-subband combination.

For step 2, the center frequencies scaling can be simplified by considering the oversampling characteristics of the complex QMF transform.

Note that in the complex QMF domain, as the pass bands of adjacent subbands overlap each other, a frequency component in the overlap zone would appear in both subbands (See International Patent Application Publication No. WO 2006048814).

As a result, the frequency scaling can be simplified to half computation amount by only calculating frequencies for those sub-subbands residing on the pass band, that is, the positive frequency part for an even subband or negative frequency part for an odd subband.

In more detail, the $k_{LF}$-th subband is split into 2Q sub-subbands. In other words, $x(n,k_{LF})$ is divided as shown in (Equation 15) below.

[Math 15]

$$y_q^{k_{LF}}(n)) \quad \text{(Equation 15)}$$

Subsequently, in order to produce the t-th order patch, the center frequencies of those sub-subbands are scaled using (Equation 16) below.

[Math 16]

$$f_{q,scale}^{k_{LF}} = \left(k_{LF}+0.5+\frac{q+0.5}{2Q}\right)\cdot\left(\frac{t}{2}\right)\cdot\frac{\pi}{M} \quad \text{(Equation 16)}$$

Here, q=−Q, −Q+1, . . . , −1 when $k_{LF}$ is odd, or q=0, 1, . . . , Q−1 when $k_{LF}$ is even.

For step 3, mapping the sub-subbands into HF subband also needs to take into account the characteristics of complex QMF transform. In the present embodiment, such a mapping process is carried out in two steps, first is to straight-forwardly map all sub-subbands on the pass band into HF subband; second, based on the above mapping result, to map all sub-subbands on the stop band into HF subband. Specifically, the mapping step includes: dividing the sub-subbands of each of the QMF subbands into a stop band part and a pass band part (hereafter referred to as the division step); computing transposed center frequencies of the sub-subbands on the pass band part with patch order dependent factor (hereafter referred to as the frequency computation step); mapping the sub-subbands on the pass band part into high frequency QMF subbands according to the center frequencies (hereafter referred to as the first mapping step); and mapping the sub-subbands on the stop band part into high frequency QMF subbands according to the sub-subbands of the pass band part (hereafter referred to as the second mapping step).

To understand the above point, it is advantageous to review what relationship exists for a pair positive frequency and negative frequency for the same signal component and their associated subband indices.

As aforementioned, in the complex QMF domain, a sinusoid spectrum has both a positive and negative frequency. Specifically, the sinusoidal spectrum has one out of those frequencies in the pass band of one QMF subband and the other of the frequencies in the stop band of an adjacent subband. Considering the QMF transform is an oddly-stacked transform, such a pair of signal components can be illustrated in FIG. 17.

Figure 17:
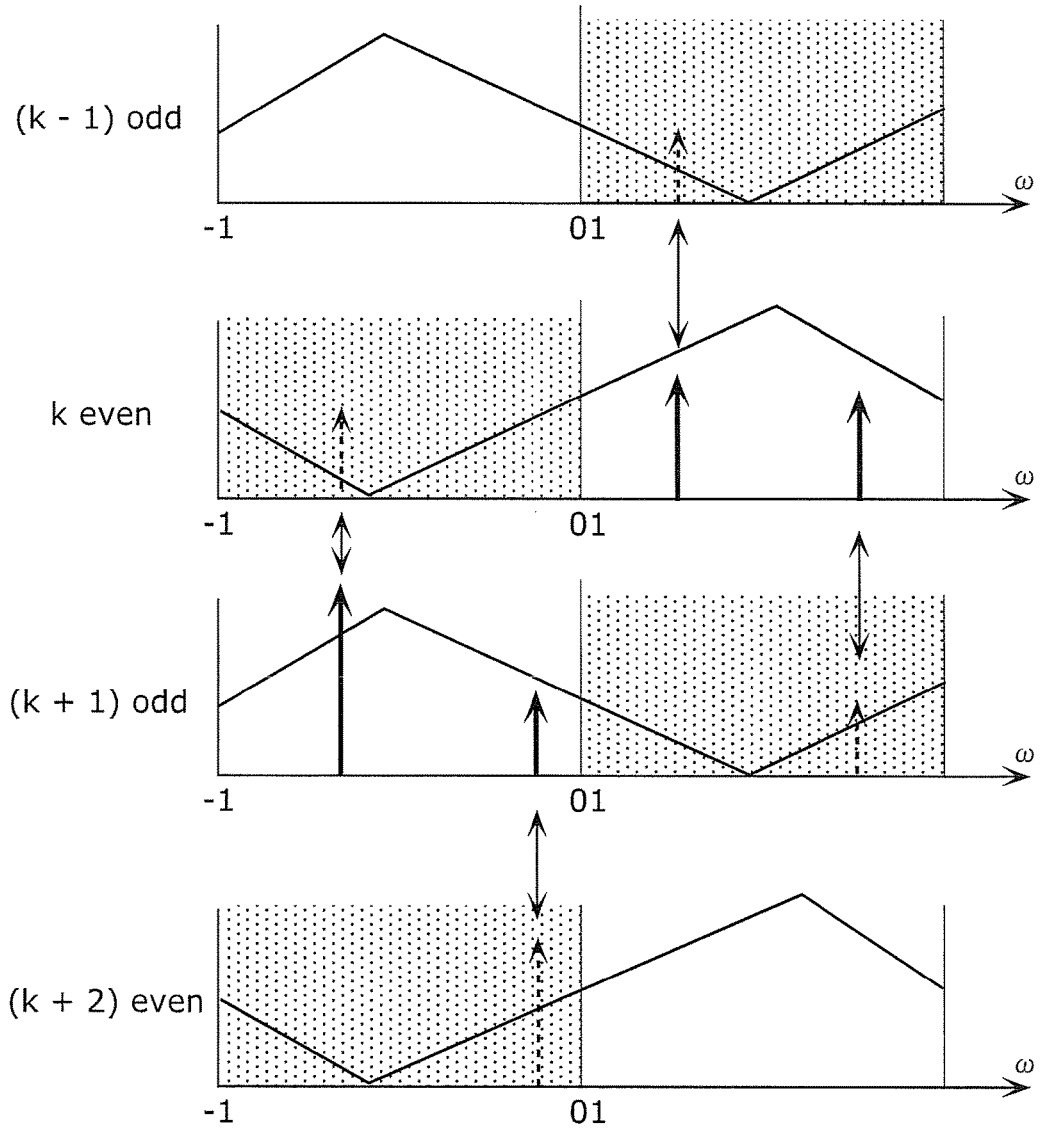
FIG. 17 is a diagram showing the relationship between the pass band component and stop band component for a sinusoidal in complex QMF domain in the second embodiment of the present invention.

FIG. 17 is a diagram showing the relationship between the pass band component and stop band component for a sinusoidal in complex QMF domain.

Here, the grey area denotes the stop band of a subband. For an arbitrary sinusoid signal (in solid line) on the pass band of a subband, its aliasing part (in dashed line) is located in the stop band of the adjacent subband (the paired two frequency components are associated by a line with double arrows).

A sinusoid signal with frequency $f_0$ as shown in (Equation 17) below.

[Math 17]

$$\frac{\pi}{(2M)} \le f_0 \le \left(1-\frac{1}{(2M)}\right)\cdot\pi \quad \text{(Equation 17)}$$

The pass band component of the sinusoidal signal with the above-described frequency $f_0$ resides on the k-th subband if (Equation 18) below is satisfied.

[Math 18]

$$\frac{k\cdot\pi}{M} \le f_0 < \frac{(k+1)\cdot\pi}{M} \quad \text{(Equation 18)}$$

In addition, its stop band component resides on the k~-th subband if (Equation 19) below is satisfied.

[Math 19]

$$\tilde{k} = \begin{cases} k-1 & \text{if } \frac{k\cdot\pi}{M} \le f_0 < \frac{(k+0.5)\cdot\pi}{M} \\ k+1 & \text{if } \frac{(k+0.5)\cdot\pi}{M} \le f_0 < \frac{(k+1)\cdot\pi}{M} \end{cases} \quad \text{(Equation 19)}$$

If a subband is decomposed into 2Q sub-subbands, the above relation is elaborated with higher frequency resolution as shown in FIG. 20 below.

[Math 20]

$$\tilde{k}_q = \begin{cases} (k-1)_q & \text{for } -Q/2 \le q < Q-1 \text{ when } k \text{ is even; or for } Q/2 \le q < Q-1 \text{ when } k \text{ is odd} \\ (k+1)_q & \text{for } -Q \le q < Q/2 \text{ when } k \text{ is even; or for } 0 \le q < Q/2 \text{ when } k \text{ is odd} \end{cases} \quad \text{(Equation 20)}$$

Therefore, in the present embodiment, in order to map the sub-subbands on the stop band into HF subband, it is necessary to associate them with the mapping results for those sub-subbands on the pass band. The motivation of such operation is to make sure that the frequency pairs for LF components are still in pair when they are upwardly shifted into HF components.

For this purpose, firstly, it is straight forward to map the sub-subbands on pass band into HF subband. By considering the center frequencies of frequency scaled sub-subbands and the frequency resolution of QMF transform, the mapping function can be described by m(k,q) as shown in (Equation 21) below.

[Math 21]

$$m(k_{LF}, q) = \left\lfloor f_{q,scale}^{k_{LF}} \cdot \frac{M}{\pi} \right\rfloor \quad \text{(Equation 21)}$$

Here, q=−Q, −Q+1, . . . , −1 if $k_{LF}$ is odd, or q=0, 1, . . . , Q−1 if $k_{LF}$ is even. Here, the coefficient shown in (Equation 22) below denotes a rounding operation to obtain the nearest integers of x towards minus infinity.

[Math 22]

$$\lfloor x \rfloor \quad \text{(Equation 22)}$$

In addition, due to the upward scaling (t/2>1), it is possible that one HF subband has a plural sub-subbands mapping sources. That is, it is possible that $m(k,q_1)=m(k,q_2)$ or $m(k_1,q_1)=m(k_2,q_2)$. Therefore, a HF subband could be a combination of multiple sub-subbands of LF subbands, as shown in (Equation 23).

[Math 23]

$$x_{pass}(n, k_{HF}) = \sum_{all\ m(k_{LF},q)=k_{HF}} y_q^{k_{LF}}(n) \quad \text{(Equation 23)}$$

Here, q=−Q, −Q+1, . . . , −1 if $k_{LF}$ is odd, or q=0, 1, . . . , Q−1 if $k_{LF}$ is even.

Secondly, following the afore-mentioned relationship between frequency pairs and subband indices, the mapping function for those sub-subbands on stop band can be established as the following.

Considering a LF subband $k_{LF}$, the mapping functions of the sub-subbands on its pass band are already decided by the 1st step as: $m(k_{LF},-Q)$, $m(k_{LF},-Q+1)$, . . . , $m(k_{LF},-1)$ for the odd $k_{LF}$ and $m(k_{LF},0)$, $m(k_{LF},1)$, . . . , $m(k_{LF},Q-1)$ for the even $k_{LF}$, then the pass band associated stop band part can be mapped according to (Equation 24) below.

[Math 24]

$$\tilde{m}(\tilde{k}_{LF,q}, q) = \begin{cases} m(k_{LF}, q) - 1 & \text{condition } a \\ m(k_{LF}, q) + 1 & \text{otherwise} \end{cases} \quad \text{(Equation 24)}$$

Here, 'condition a' refers to when $k_{LF}$ is even and (Equation 25) below is even, or when $k_{LF}$ is odd and (Equation 26) below is even.

[Math 25]

$$\left\lfloor \frac{(q+0.5)\cdot t}{Q} \right\rfloor \quad \text{(Equation 25)}$$

[Math 26]

$$\left\lfloor t + \frac{(q+0.5)\cdot t}{Q} \right\rfloor \quad \text{(Equation 26)}$$

In addition, as described above, (Equation 27) below denotes a rounding operation to obtain the nearest integers of x towards minus infinity.

[Math 27]

$$\lfloor x \rfloor \quad \text{(Equation 27)}$$

The resulting HF subband is the combination of all associated LF sub-subbands, as shown in (Equation 28) below.

[Math 28]

$$x_{stop}(n, k_{HF}) = \sum_{all\ \tilde{m}(\tilde{k}_{LF},q)=k_{HF}} y_q^{\tilde{k}_{LF},q}(n) \quad \text{(Equation 28)}$$

Here, q=−Q, −Q+1, . . . , −1 if $k_{LF}$ is even, or q=0, 1, . . . , Q−1 if $k_{LF}$ is odd.

In the end, all mapping results on the pass band and stop band are combined to form the HF subband, as shown in (Equation 29) below.

[Math 29]

$$x(n,k_{HF}) = x_{pass}(n,k_{HF}) + x_{stop}(n,k_{HF}) \quad \text{(Equation 29)}$$

Note that the above pitch shifting method in QMF domain benefits both high frequency quality degradation and possible transient handling problem.

Firstly, all patches now have the same stretching factor, the smallest one, which greatly reduces the high frequency noises (coming from those incorrect signal components generated during time stretching). Secondly, all contribution sources for transient degradation are avoided. That is, there is no time domain resampling process; the same stretching factors are used for all patches, which inherently eliminated the possibility of misalignment.

In addition, it should be noted that the present embodiment has some downside at the frequency resolution. Note that due to adopting sub-subband filtering, the frequency resolution is increased from Π/M to Π/(2Q·M), but it is still coarser than the fine frequency resolution of time domain resampling (Π/L). Nevertheless, considering the human ear has less sensitivity to high frequency signal component, the pitch shifted result produced by the present embodiment is proved to be perceptually no different with that produced by the resampling method.

Apart from the above, comparing to the HBE scheme in the first embodiment, the HBE scheme in the present embodiment also provides a bonus with further reduced computation amount, because only one low order patch needs time stretching operation.

Again, such a computation amount reduction can be roughly analyzed by only considering the computation amount contributed from transforms.

Following the assumptions in aforementioned computation amount analysis, the transform computation amount involved in the HF spectrum generator in the present embodiment is approximated as shown below.

[Math 30]

$$2\cdot(2L/2)\cdot\log_2(2L/2)=2\cdot L\cdot\log_2(L) \quad \text{(Equation 30)}$$

Therefore, Table 1 can be updated as the following.

TABLE 2

Computation amount comparison between the HBE in the present embodiment and the HBE scheme in the first embodiment

| Harmonic patch number (T) | Transform computation amount involved in HBE in present embodiment | Transform computation amount involved in HBE in first embodiment | Computation amount ratios |
|---|---|---|---|
| 3 | 20480 | 33335 | 61.4% |
| 4 | 20480 | 42551 | 48.1% |
| 5 | 20480 | 49660 | 41.2% |

The present invention is a new HBE technology for low bit rate audio coding. Using this technology, a wide-band signal can be reconstructed based on a low frequency bandwidth signal by generating its high frequency (HF) part via time stretching and frequency extending the low frequency (LF) part in QMF domain. Comparing to the prior art HBE technology, the present invention provides comparable sound quality and much lower computation count. Such a technology can be deployed in such applications as mobile phone, tele-conferencing, etc, where audio codec operates at a low bit rate with low computation amount.

It should be noted that each of the function blocks in the block diagrams (FIGS. 6, 7, 13, 14, and so on) are typically realized as an LSI which is an integrated circuit. The function blocks may be realized as separate individual chips, or as a single chip to include a part or all thereof.

Although an LSI is referred to here, there are instances where the designations IC, system LSI, super LSI, ultra-LSI are used due to the difference in the degree of integration.

In addition, the means for circuit integration is not limited to an LSI, and implementation with a dedicated circuit or a general-purpose processor is also available. It is also acceptable to use a Field Programmable Gate Array (FPGA) that allows programming after the LSI has been manufactured, and a reconfigurable processor in which connections and settings of circuit cells within the LSI are reconfigurable.

Furthermore, if integrated circuit technology that replaces LSI appears through progress in semiconductor technology or other derived technology, that technology can naturally be used to carry out integration of the function blocks.

Furthermore, among the respective function blocks, the unit which stores data to be coded or decoded may be made into a separate structure without being included in the single chip.

INDUSTRIAL APPLICABILITY

The present invention relates to a new harmonic bandwidth extension (HBE) technology for low bit rate audio coding. With the technology, a wide-band signal can be reconstructed based on a low frequency bandwidth signal by generating its high frequency (HF) part via time stretching and frequency-extending the low frequency (LF) part in QMF domain. Comparing to the prior art HBE technology, the present invention provides comparable sound quality and much lower computation amount. Such a technology can be deployed in such applications as mobile phones, tele-conferencing, etc, where audio codec operates at a low bit rate with low computation amount.

REFERENCE SIGNS LIST

501-503, 602, 604, 605 Bandpass unit
504-506 Sampling unit
507-509, 601, 1404, 1505 QMF transform unit
510-512, 603 Phase vocoder
513-515, 608-610, 1407, 1505, 1509 Delay alignment unit
516, 611, 1410, 1511, 1512 Addition unit
606, 607 Frequency extension unit
1401, 1501 Demultiplex unit
1402, 1502 Decoding unit
1403 Time resampling unit
1405, 1504 Time-stretching unit
1406, 1508 T-F transform unit
1409, 1510 Inverse T-F transform unit
1506 Pitch-shifting unit

The invention claimed is:

1. A bandwidth extension method for producing a full bandwidth signal from a low frequency bandwidth signal, the low frequency bandwidth signal being an audio signal, said method comprising:

transforming the low frequency bandwidth signal into a quadrature mirror filter bank (QMF) domain to generate a first low frequency QMF spectrum;

generating a low order harmonic patch by time-stretching the low frequency bandwidth signal by transforming the low frequency bandwidth signal into a second low frequency QMF spectrum having finer frequency resolution than the first low frequency QMF spectrum;

generating signals that are pitch shifted, by applying different shift coefficients to the low order harmonic patch, and generating a high frequency QMF spectrum from the signals; and generating the full bandwidth signal by combining the high frequency QMF spectrum with the first low frequency QMF spectrum, wherein said generating signals that are pitch shifted includes:

bandpassing the low order harmonic patch to generate bandpassed patches;

mapping each of the bandpassed patches into high frequency to generate high order harmonic patches; and summing up the high order harmonic patches with the low order harmonic patch.

2. A bandwidth extension apparatus that produces a full bandwidth signal from a low frequency bandwidth signal, the low frequency bandwidth signal being an audio signal, said bandwidth extension apparatus comprising:

a first transform circuit configured to transform the low frequency bandwidth signal into a quadrature mirror filter bank (QMF) domain to generate a first low frequency QMF spectrum;

a low order harmonic patch generation circuit configured to generate a low order harmonic patch by time-stretching the low frequency bandwidth signal by transforming the low frequency bandwidth signal into a second low frequency QMF spectrum having finer frequency resolution than the first low frequency QMF spectrum;

a high frequency generation circuit configured to (i) generate signals that are pitch shifted, by applying different shift coefficients to the low order harmonic patch, and (ii) generate a high frequency QMF spectrum from the signals; and a full bandwidth generation circuit configured to generate the full bandwidth signal by combining the high frequency QMF spectrum with the first low frequency QMF spectrum, wherein said high frequency generation circuit includes:

a patch generation circuit configured to bandpass the low order harmonic patch to generate bandpassed patches;

a high order generation circuit configured to map each of the bandpassed patches into high frequency to generate high order harmonic patches; and a summing circuit configured to sum up the high order harmonic patches with the low order harmonic patch.

3. A non-transitory computer-readable recording medium on which a program for producing a full bandwidth signal from a low frequency bandwidth signal is recorded, the low frequency bandwidth signal being an audio signal, the program causing a computer to execute:

transforming the low frequency bandwidth signal into a quadrature mirror filter bank (QMF) domain to generate a first low frequency QMF spectrum;

generating a low order harmonic patch by time-stretching the low frequency bandwidth signal by transforming the low frequency bandwidth signal into a second low frequency QMF spectrum having finer frequency resolution than the first low frequency QMF spectrum;

generating signals that are pitch shifted, by applying different shift coefficients to the low order harmonic patch, and generating a high frequency QMF spectrum from the signals; and generating the full bandwidth signal by combining the high frequency QMF spectrum with the first low frequency QMF spectrum, wherein said generating signals that are pitch shifted includes:

bandpassing the low order harmonic patch to generate bandpassed patches;

mapping each of the bandpassed patches into high frequency to generate high order harmonic patches; and summing up the high order harmonic patches with the low order harmonic patch.

4. An integrated circuit that produces a full bandwidth signal from a low frequency bandwidth signal, the low frequency bandwidth signal being an audio signal, said bandwidth extension apparatus comprising:

a first transform circuit configured to transform the low frequency bandwidth signal into a quadrature mirror filter bank (QMF) domain to generate a first low frequency QMF spectrum;

a low order harmonic patch generation circuit configured to generate a low order harmonic patch by transforming the low frequency bandwidth signal into a second low frequency QMF spectrum having finer frequency resolution than the first low frequency QMF spectrum;

a high frequency generation circuit configured to (i) generate signals that are pitch shifted, by applying different shift coefficients to the low order harmonic patch, and (ii) generate a high frequency QMF spectrum from the signals; and a full bandwidth generation circuit configured to generate the full bandwidth signal by combining the high frequency QMF spectrum with the first low frequency QMF spectrum, wherein said high frequency generation circuit includes:

a patch generation circuit configured to bandpass the low order harmonic patch to generate bandpassed patches;

a high order generation circuit configured to map each of the bandpassed patches into high frequency to generate high order harmonic patches; and a summing circuit configured to sum up the high order harmonic patches with the low order harmonic patch.

5. An audio decoding apparatus comprising:

a separation circuit configured to separate a coded low frequency bandwidth signal from coded information;

a decoding circuit configured to decode the coded low frequency bandwidth signal;

a transform circuit configured to transform the low frequency bandwidth signal generated through the decoding by said decoding circuit, into a quadrature mirror filter bank (QMF) domain to generate a low frequency QMF spectrum;

a low order harmonic patch generation circuit configured to generate a low order harmonic patch by transforming the low frequency bandwidth signal into a second low frequency QMF spectrum having finer frequency resolution than the first low frequency QMF spectrum;

a high frequency generation circuit configured to (i) generate signals that are pitch shifted, by applying different shift coefficients to the low order harmonic patch, and (ii) generate a high frequency QMF spectrum from the signals;

a full bandwidth generation circuit configured to generate the full bandwidth signal by combining the high frequency QMF spectrum with the low frequency QMF spectrum; and an inverse transform circuit configured to transform the full bandwidth signal, from a quadrature mirror filter bank (QMF) domain signal to a time domain signal, wherein said high frequency generation circuit includes:

a patch generation circuit configured to bandpass the low order harmonic patch to generate bandpassed patches;

a high order generation circuit configured to map each of the bandpassed patches into high frequency to generate high order harmonic patches; and a summing circuit configured to sum up the high order harmonic patches with the low order harmonic patch.

* * * * *